United States Patent [19]

Rilett

[11] Patent Number: 4,854,343

[45] Date of Patent: Aug. 8, 1989

[54] FLUID CONTAINERS

[76] Inventor: John W. Rilett, Hilltop House, Old Quarry,, Bibury, Gloucestershire, United Kingdom

[21] Appl. No.: 160,276

[22] Filed: Feb. 25, 1988

Related U.S. Application Data

[63] Continuation-in-part of Ser. No. 904,065, Sep. 5, 1986, which is a continuation of Ser. No. 448,904, Dec. 3, 1982.

[30] Foreign Application Priority Data

Apr. 6, 1981 [GB] United Kingdom ..... 8110733

[51] Int. Cl.[4] ..... B65D 83/14

[52] U.S. Cl. ..... 137/543.19; 251/126; 222/396; 220/901

[58] Field of Search ..... 137/212, 540, 543.19, 137/538; 251/118, 126; 222/396; 220/3.1, 900, 901

[56] References Cited

U.S. PATENT DOCUMENTS

| | | | |
|---|---|---|---|
| 1,022,330 | 4/1912 | Ramsey | 251/118 |
| 1,550,122 | 8/1925 | Swisher | 137/557 X |
| 2,018,543 | 10/1935 | Buirk | 137/212 X |
| 3,229,716 | 1/1966 | Johnson et al. | 137/543.19 X |
| 3,247,967 | 4/1966 | Kucmerosky | 251/126 |
| 3,308,990 | 3/1967 | Klasson et al. | 137/212 X |
| 3,503,418 | 3/1970 | Petrucci et al. | 137/540 X |
| 3,709,241 | 1/1973 | McJones | 137/540 X |
| 3,782,412 | 1/1974 | Darash | 137/540 X |
| 4,049,017 | 9/1977 | Jones | 137/540 |
| 4,140,148 | 2/1979 | Richter | 137/540 |
| 4,350,179 | 9/1982 | Bunn et al. | 137/540 |

*Primary Examiner*—John Rivell

*Attorney, Agent, or Firm*—Berman, Aisenberg & Platt

[57] ABSTRACT

Containers for storing fluids, especially carbon dioxide, under pressure comprise a tubular component (made of a deformable material capable of at least 7% elongation before fracture) which is preferably closed by a top plug with a filling/emptying device (and any end plug) by crimping open end(s) of the component over a circumferential shoulder on the plug(s). A primary pressure relief device comprising a poppet with a piston section, a return spring and a control (exit) orifice tolerates and ejects dirt, prevents the formation of solid phase material and vents the contents in brief spurts so as to minimize loss. Desirably, a narrow helical conduit connects the primary pressure relief device to the container interior and, by being in thermal contact with the tubular component, chills the contents during venting so as to minimize loss. One or more secondary pressure relief devices, such as bursting discs, may also be incorporated to vent substantially the whole contents in the event that the primary pressure relief device fails to maintain the internal pressure below a safe predetermined level. The construction allows the fitting of alternative adaptor assemblies for various uses and lends itself to automatic assembly. The use of a heat storage substance is also disclosed.

58 Claims, 4 Drawing Sheets

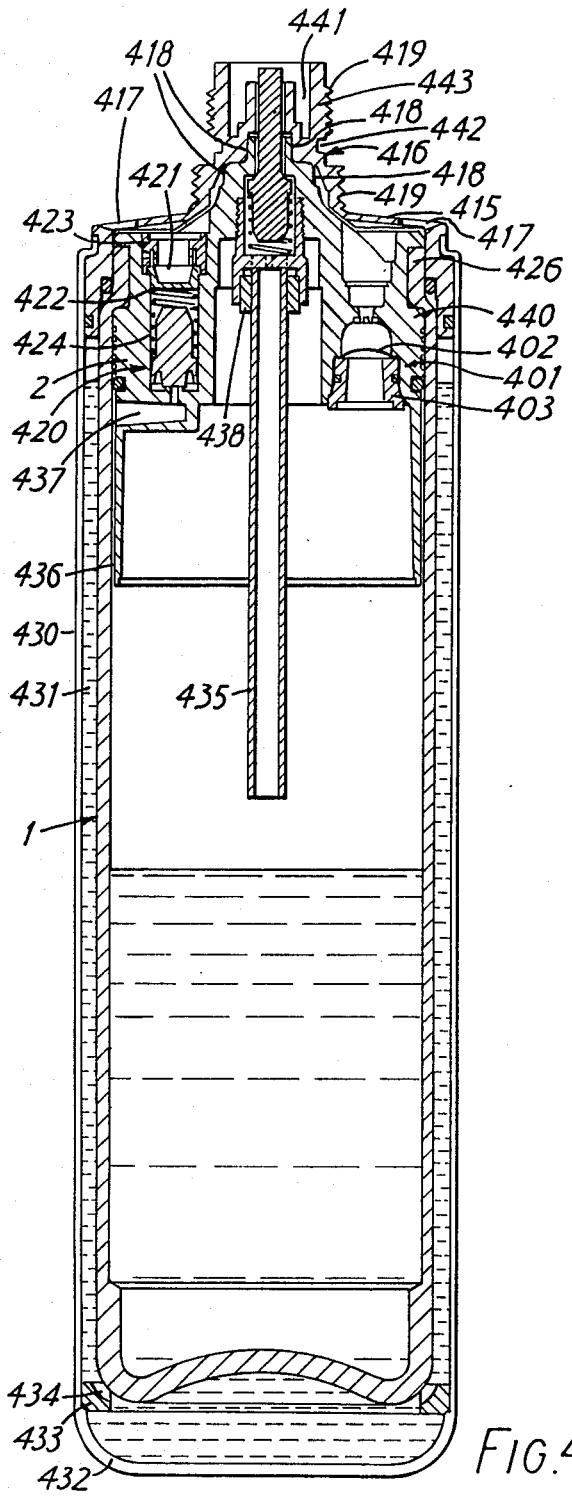
FIG. 4
FIG. 4A
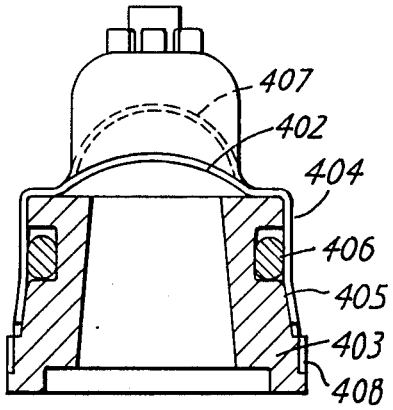
FIG. 4B
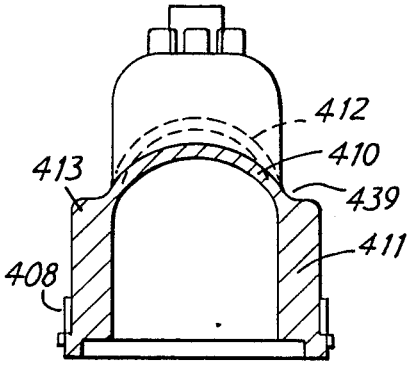

FLUID CONTAINERS

RELATED APPLICATION

This application is a continuation in part of Ser. No. 904,065, filed Sept. 5, 1986, which is a continuation of Ser. No. 448,904, filed Dec. 3, 1982.

FIELD OF THE INVENTION

The present invention relates to containers for the storage of fluids under pressure. In general, the present invention is concerned with containers used for storing and dispensing either the so-called "permanent" gases, such as nitrogen, oxygen, argon, neon, xenon, helium and the like, which are always gaseous at normal climatic temperatures; or those gases that may be liquefied and stored at normal climatic temperatures under the effect of pressure alone, such as carbon dioxide, the freons ®, butane, propane, nitrous oxide, ammonia and the like. In particular, the present invention is concerned with containers for storing and dispensing such fluids wherein the said containers are of partly o substantially cylindrical form and wherein the cylindrical part of the container usually comprises a metallic (but sometimes a plastic or other deformable) material.

BACKGROUND

Small cylinders containing carbon dioxide are well known and are available under the registered trade marks sparklets and sodastream. Such cylinders normally have capacities between 300 and 405 cubic centimeters and are normally used to supply gaseous carbon dioxide for domestic water carbonators and, more recently, to dispense either gaseous or liquid carbon dioxide for use in pneumatic power devices, such as model aircraft motors, power tools, garden pressure sprayers, automatic shavers, automatic starters for petro-engined lawn mowers, wherein the high-pressure carbon dioxide provides mechanical power. A preferred embodiment of the present invention, described later in this specification, is intended for suchlike uses especially.

However, the present invention may also be employed in a wide variety of other applications, such as fire extinguishers, cylinders containing medical gases, cylinders containing a variety of gases or liquids as already distributed for use in laboratories, and much larger (e.g. 5-50 liter capacity) cylinders, such as those used in the distribution of nitrogen, oxygen, propane, butane, carbon dioxide and acetylene, to industrial users for welding, metal-cutting, heating and other uses.

The background art employed in these known types of cylinders suffers from a number of disadvantages. For example, the most favored method of constructing cylinders for use in carbonators and fire extinguishers employs steel tubing which must be heated (usually by a gas flame) until the steel can begin to flow, whereupon the base of the cylinder is closed by hot-spinning; this process often causes slag-inclusion in the base, weakening the base and allowing slow leakage of gas from the cylinder during service. In addition, the other end of this type of steel cylinder (to which the valve is affixed) is also formed by hot-spinning or hot-swaging s as to provide a "neck reduction", and this process is usually labour-intensive and costly. Both of these hot-forming operations produces oxides which, despite subsequent interior washing, remain on the interior walls and then later become detached during service and so contaminate the cylinder contents. Furthermore, the steel commonly used in these cylinders is prone to corrosion by moisture and other contaminants present in many commercial gases. All such corrosion products and oxides tend to become finely divided and so can then pass through the filter usually provided in the cylinder's valve assembly, causing contamination of the carbonator or other appliance served by the gas cylinder.

In another known form of cylinder construction, the cylinder is formed by cold deep-drawing of steel sheet and wall-ironing, followed by neck reduction to permit attachment of the valve assembly. The extensive cold working of the steel during this process necessitates subsequent heat treatment of the entire cylinder, which removes much of the strength that had been imparted by the wall-ironing process.

Both the hot-forming of the first-mentioned method of cylinder construction, and the heat treatment needed in the second method, result in a considerable reduction in the strength of the steel wall and, in consequence, the wall thickness must be significantly increased for any desired burst pressure. Hence such cylinders are unduly wasteful of steel material, costly and heavy—which increases their cost of transportation.

Finally, in a third known type of construction the cylinder has one or two domed ends which are attached to a central cylindrical metal section by welding-on the domed ends and, sometimes, also has a welded seam in the cylindrical section. Such welding is costly and prone to defects and, furthermore, affects the material properties adjacent to each weld line so that subsequent heat treatment is often necessary, as well as giving rise to contamination of the cylinder interior.

SUMMARY OF THE INVENTION

The present invention seeks to eliminate the heretofore-described disadvantages of current methods of gas cylinder construction. Accordingly, the present invention proposes means to avoid all forms of hot-working of the cylinder material, welding, and the heat treatment often now necessary after forming or welding; in consequence the formation of oxides and other corrosion products is avoided, the material of the cylinder can be used in its maximum or optimum strength condition, and the wall thickness, weight and cost of the cylinder can be reduced considerably.

Further, the present invention seeks to provide forms of pressure-relief integral with the cylinder design, whereby any rise in internal pressure (caused, for example, by over-filling or exposure to heat) above a predetermined level will be relieved by the venting-off of excess fluid with a high degree of safety and reliability. By these means the wall thickness of the cylinder materials may be further reduced, and the cylinder cost and weight minimised.

In addition the present invention seeks to provide features such that any fluid being vented from the primary pressure-relief device will produce a chilling effect on the cylinder wall and hence tend to counteract the pressure build-up that caused venting. By this means, unintentional short-term exposure to heat will result in a significantly reduced loss of fluid.

The present invention (in relation to its use in containers for gases, such as carbon dioxide, which change to solid phase after venting to atmosphere) also seeks to provide means firstly to maintain any venting fluid substantially in its gaseous state and secondly to ensure that any phase change will be to the liquid phase rather than to the solid phase. By these means, the risk of solid phase formation in the primary pressure-relief device (which, in previous known art, may block or jam the pressure-relief device and render the cylinder dangerous) can be totally eliminated.

Further, the present invention seeks to provide means to regulate the rate of discharge of fluid during venting of the primary pressure-relief device, so that such venting is relatively gentle and quiet, and also to provide at least one secondary pressure-relief device as a back-up to the primary pressure-relief device and characterised firstly in that the secondary pressure-relief device(s) will vent fluid at a more rapid rate than that of the primary pressure-relief device (and in a more noisy manner so as to attract attention) and secondly in that the secondary pressure-relief device(s) will vent substantially the whole contents of the cylinder and render it unusable for storing further fluid until it is returned to the manufacturer for examination and rectification of any fault in the primary pressure-relief device.

Also, the present invention seeks to provide a means of construction of fluid cylinders which, including a cylindrical component forming a pressure vessel with one or two open ends, is largely comprised of plastic or metallic components that can be inexpensively produced by, e.g., injection moulding, diecasting, sintering, etc., with a minimum of machining and labour costs.

The present invention in addition seeks to provide a means of construction of fluid cylinders which lends itself to automatic or semi-automatic assembly, by means of employing a design allowing axial assembly of substantially all of its components and whereby rotation about the axis of the cylinder (for instance on a lathe adapted for the purpose) allows the cylinder's shell to be trimmed to length and spun into a retention groove.

Furthermore, the present invention seeks to provide a means allowing a basic standard cylinder to be fitted with, as desired by the end-user, any one of several alternative adaptor assemblies, whereby such adaptor assemblies permit the coupling of the basic standard cylinder to any of a variety of appliances (e.g. water carbonators of various designs, various fire extinguishers, various medical equipment, various welding and industrial equipment) and also permit the dispensing of the cylinder contents in either gaseous or liquid form through, for example, an adaptor assembly fitted with a dispensing nozzle. By this means one basic standard cylinder can satisfy a large number of uses and, because the said adaptor assemblies can be easily detached, only the basic standard cylinder need be returned for refilling, thus reducing transportation costs.

Thus the present invention provides a container of substantially cylindrical shape for storing fluids under pressure consisting of a tubular component made of a deformable material capable of at least 7% elongation before fracture in which at least one open thereof is closed by engagement with a substantially cylindrical closure member which is inserted into the open end, the closure member having located therein a filling/emptying device for the container and an outside diameter which is substantially equal to the internal diameter of the tubular component.

Preferably, the substantially-cylindrical component of the fluid cylinder will comprise tubular metal (such as aluminum alloy, carbon steel, stainless steel, brass, copper or other desired metal) or plastic or other deformable material which, during its manufacture in bulk, has already been treated to produce the desired strength and other material properties including, for the purpose of the present invention, at least 7% (seven per cent) elongation before fracture or cracking. Such properties can be achieved by bulk processing, such as heat treatment and plastic quality control, during bulk manufacture rather than during subsequent fluid cylinder manufacture. Moreover, any necessary washing, removal of corrosion products, anodising, plating, etc., may also be done during bulk material manufacture, thus obviating the many disadvantages of current fluid cylinder manufacturing processes as heretofore described. The present invention proposes two variations of a common approach whereby the invention may be put into practice: in the first variation, the main substantially-cylindrical component of the fluid cylinder (hereinafter referred to for brevity as the "tubular component") comprises an appropriate length of tube of the chosen 7%-deformable metallic, plastic or other chosen material and which will thus have two open ends; in the second variation, the tubular component will have one open end only and may comprise an impact extrusion in aluminum or one of its alloys or copper, etc., a deep drawing from sheet metal, an injection-moulded or vacuum-formed plastic component, an, e.g., compression-moulded thermosetting plastic component, a cast or diecast or investment cast or sintered metallic component, and in which one end is closed in the form of a hemisphere, ellipsoid, semi-ellipsoid, part-torisphere or other desired shape.

In order to seal the or both open end(s) of the tubular component while avoiding the substantial neck reduction or welding employed in existing fluid cylinder construction, the present invention proposes the insertion of a closely-fitting to tightly-fitting substantially-cylindrical closure member (hereinafter referred to as a "top plug") into the or one open end of the tubular component and, in the case of a tubular component with two open ends, the insertion of a closely-fitting to tightly-fitting substantially-cylindrical end member (hereinafter referred to as an "end plug") into the other end. Such top and end plugs are advantageously made from high-strength engineering plastic material, such as acetal, polyacetal, polyamide, polyester (such as polybutylene terephthalate or polyethylene terephthalate), polycarbonate or the like, as desired for the required strength and chemical compatibility with the fluid to be contained glass-reinforced if additional strength or dimensional stability is desired, and preferably injection-moulded for ease of production. However, the present invention does not exclude the use of other materials and means of manufacture for the top and any end plugs, and diecast or investment cast or sintered, etc., metal, or other plastic or other materials and desired manufacturing methods may be employed. However, the present invention does require that such top and end plugs shall be closely-fitting to tightly-fitting (with, advantageously, a slight interference fit, e.g., where the outside diameter of the closure member is from 0.2% to 1.0% greater than the internal diameter of the tubular component) in the tubular component, shall preferably be provided each with at least one circumferential seal (which may be a known elastomeric 'O', ring or other sealing means, or which may even be an integral part of each top or end plug if made of suitably resilient material) and shall desirably be formed with a circumferential shoulder over which the or each open end of the tubular component may be, e.g., cold-spun to a lesser diameter, preferably having a spinning groove or cylindrical surface beyond such circumferential shoulder and of approximately 7% less diameter than the shoulder so as to form a firm cylindrical core onto which the or each open end of the tubular component will be cold-spun or otherwise deformed (this process being hereinafter referred to, for brevity, as "cold spun" where such expression is intended to include other means of deformation, such as crimping, rolling, swaging and the like) to a slightly lesser diameter so as to grip the cylindrical shoulder and core.

In some embodiments of the present invention, in particular for containers of fluid at relatively low pressure, the cold-spun lip so far described will prove adequate to retain any top or end plugs, especially as the cold-spinning process will increase the strength and stiffness of several metals and alloys by virtue of the approximately-7% cold working imparted on the lip. However, in many other embodiments, such as containers for carbon dioxide and other fluids at pressures of perhaps 50 bar and above, the present invention proposes either a container in which that part of the tubular component which is deformed to provide a lip has a wall which is greater in thickness and thereby stronger than the remaining cylinder wall of the component, and/or means to secure the cold-spun lip and thereby to retain the top plug and any end plug firmly, by providing a retaining band in the form of a cylindrical ring of metal, plastic or other high-strength material of an internal diameter substantially equal to or slightly greater than the outside diameter of the cold-spun lip, and of a length appropriate to gripping the cold-spun lip's circumference closely adjacent to the circumferential shoulder. Such a retaining band will be fixed in position by using either of two preferred methods: in the case of a retaining band of inside diameter greater than the outside diameter of the cold-spun lip, a gap-filling adhesive, such as plastic padding ®, devon ® or the like, is applied to the cold-spun lip and the retaining band slid over it (up to the shoulder or, if the retaining band has an even larger inside diameter, over the shoulder) so that the gap-filling adhesive does fill substantially all of the gap between the cold-spun lip and the retaining band; and in the case of a retaining band of inside diameter equal to or less than the outside diameter of the cold-spun lip, the retaining band will be slightly increased in diameter (by means of a suitable tool of known type or by means of heating so as to expand it temporarily), slid over the cold-spun lip and up to the shoulder, and allowed to shrink back again to grip the cold-spun lip firmly.

The use of a retaining band as so far described will normally prove adequate for containers holding fluids at pressures up to 100–200 bar (depending on the material and wall thickness of the tubular component). However, for higher pressures or greater security or both, the present invention proposes that the retaining band should be provided with a circumferential ridge on its inside surface to engage with a circumferential groove on the outer surface of the cold-spun lip, the retaining band being stretched or heat-expanded to permit assembly and then allowed to shrink so that the ridge engages with the groove. The local thinning of the cold-spun lip caused by the said circumferential groove is permissible from the standpoint of strength because, by the nature of the present invention, the cold-spun lip does not experience any significant hoop stress or longitudinal stress arising from the pressure of the contained fluid. Preferably, but not essentially, the said circumferential ridge and the mating circumferential groove should each have a cross-section in the shape of a saw-tooth oriented so that the circumferential ridge acts as a barb to prevent any incipient movement of the cold-spun lip towards the shoulder over which it was cold-spun. The efficacy of the retaining band disclosed in the present invention follows from the fact that any incipient tendency of the cold-spun lip to expand and draw back over the shoulder provided on any top or end plug is firmly prevented by the additional hoop strength provided by the retaining band.

The filling/emptying device for the container may be of a known type and preferably is located in the top plug (closure member), so that its longitudinal axis lies on or substantially parallel to the longitudinal axis of the tubular component.

The present invention also comprises firstly a primary pressure-relief device for location in the top plug of the type which will vent excess pressure and then re-seal, by using a poppet that is spring-loaded against an orifice which, when the poppet is just unseated from the orifice, communicates with the interior of the cylinder and allows fluid under pressure to flow from there, usually via one or more scratch grooves in the wall of the poppet valve cylinder, to the exterior of the cylinder. Such a pressure-relief device may be one of several known types but, according to the present invention, the said poppet (which term includes any housing to which the poppet per se is fitted) is situated in a cavity which conforms closely to the exterior of the poppet and in which the poppet may move slidably and be guided by the walls of the cavity to move away from and towards the orifice, so that the poppet acts as a loosely-fitting piston of diameter substantially larger than the sealing diameter of the poppet where it seals the orifice. By this means, as soon as the poppet is lifted off the orifice by the force generated by the fluid pressure acting on the cross-sectional area bounded by the orifice sealing diameter's circumference, the escaping fluid imparts a larger lifting force by acting on the larger cross-sectional area of the piston section of the poppet. This causes the poppet to be lifted further off the orifice, allowing any dirt or grit (which occasionally exists in commercial gas supplies) or solid phase derived from the contained fluid to escape with less likelihood of damage to the poppet's or orifice's sealing surface, and reducing the incidence of poppet "chatter" against the orifice with undesirable wear and other consequences. The extent of this additional poppet lift may be further controlled by the provision of longitudinal channels for fluid and, e.g., dirt escape, e.g., either in the wall of the poppet valve cylinder or on the exterior surface of the poppet so as to regulate the rate of flow of the escaping fluid, its fall in pressure from front to back of the poppet, and so the additional force therefrom which provides additional poppet lift.

A further feature of the primary pressure-relief device according to the present invention is the provision of at least one outlet orifice downstream of the poppet for control of escaping fluid flow rate. In general, this feature allows the minimisation of fluid loss during operation of the primary pressure-relief device, by limiting the rate of flow of the escaping fluid and by causing a rise in fluid pressure downstream of the poppet, thereby providing a fluid force on the downstream side of the poppet, tending to return the poppet smartly against the orifice so as to reseal it soon after venting first started. This feature also allows the action of venting to be relatively gentle and quiet. However, if desired, an audible alarm device can be incorporated in the primary pressure relief device at this point to provide a clear warning that fluid venting is occurring. In the particular case of fluids, such as carbon dioxide, which cannot exist in their solid phase above a certain threshold pressure (5.3 absolute atmospheres in the case of carbon dioxide), this feature of an outlet orifice provides, furthermore, a means to maintain the fluid pressure in the cavity between the poppet and the outlet orifice at a level higher than that threshold pressure, so ensuring that, during venting, only gas and maybe liquid phase can exist in that cavity (and be easily discharged therefrom) and that no solid phase can form therein and endanger the reliable operation of the primary pressure-relief device by causing jamming or blockage.

For instance in the case of a container of carbon dioxide whose liquid phase generates a gas pressure of about 55 bar at normal ambient temperatures, the primary pressure-relief device as aforesaid may be set to relieve at 90 bar internal pressure, thereby venting gas only when, for example, the filling ratio exceeds 0.60 and the temperature exceeds 37° C.

A secondary pressure-relief device, also for location in the top plug, of a non-resealing type is further disclosed. This secondary device may be of several known types, such as a bursting disc or a diaphragm plus shear pin, but, in any event, will be designed to relieve all of the fluid contents if the internal pressure rises significantly above the relief pressure of the primary pressure-relief device (which would indicate that either the primary pressure-relief device had failed to operate or that it could not vent fluid sufficiently quickly in the event, for example, that the fluid container had fallen into boiling water or had been caught in a fire) and so render the fluid container harmless and unusable until returned for examination and rectification. For example in the case of carbon dioxide containers with a primary pressure-relief device normally operating at 90 bar, the secondary device may be designed to operate at 120 bar internal pressure. According to the present invention, a form of such a secondary pressure-relief device of extremely low cost is disclosed, referred to hereinafter as a "blow ring". Such a blow ring may advantageously comprise a toroidal ring of elastomeric material, such as a well known 'O' ring of nitrile rubber, situated in and normally sealing an annular recess communicating on its upstream side with the interior of the fluid container and on its downstream side with the container's exterior. The annular recess will have an annular width (in the region where the blow ring is normally situated) of approximately 60–90% of the uncompressed cross-sectional diameter of the blow ring, thus squeezing the blow ring by about 20% so as to seal the annular recess against escape of contained fluid. However, the annular recess in the region immediately downstream of the normal position of the blow ring is formed, according to the present invention, so that its annular width decreases to approximately 20% to 50% of the blow ring cross-sectional diameter (depending on the desired secondary relief pressure) so as to form an annular "throat" against which the blow ring is urged by the internal fluid pressure. Downstream of this annular throat, a second annular recess or space is provided of a size and shape so that the blow ring will not seal it against escape of contained fluid. In operation, at the desired secondary relief pressure, the blow ring is urged by the internal fluid pressure so as to move partly or substantially through the annular throat, causing a sudden escape of fluid (advantageously in a noisy manner so as to attract attention), substantially emptying all the contents of the container, and normally causing the blow ring to move beyond the annular throat into the second annular recess of space so that, when, for example, the container is returned for examination, the position therein of the blow ring will indicate that the primary pressure-relief device had failed to vent fluid adequately and that the blow ring had indeed operated. The annular form of the secondary pressure-relief device is suggested as only one form according to the present invention, and it may take several other forms, such as, for example, an elastomeric ball in a frusto-conical recess with a circular throat or an elastomeric or resilient plastic cylinder in a paraboloid recess with an elliptical throat. However, all forms according to the present invention will substantially comprise a first recess communicating with the container interior, a resilient sealing member normally situated in the first recess and sized so as to be squeezed in the first recess by an amount sufficient to seal the first recess against fluid flow from the container interior to the container exterior at internal pressures below a certain relief pressure, a throat downstream of and of a lesser cross-sectional area than the first recess so as to prevent passage therethrough of the resilient sealing member except at internal pressures higher than the certain relief pressure, and a second recess or space downstream of the throat having a size and shape so that the resilient sealing member will not seal it against escape of fluid from the container, the second recess communicating with the container exterior and the resilient sealing member being of such resilience and size as to allow it to move from the first recess and through the throat at a contained fluid pressure higher than the certain relief pressure.

In addition to the just-described secondary pressure-relief device, it is sometimes advantageous for even greater safety to provide a further back-up relief device also located in the top plug, such as a bursting disc which will burst at a pressure higher than the relief pressure of the primary pressure-relief device and, usually, of the secondary pressure-relief device also. Such bursting discs may be metallic or of a plastic material (e.g. of the same material as the top plug). Preferably, the metallic disc has a skirt portion of a length which is at least 20% of the diameter of the disc. A skirt length of this order provides a more secure fitting for the disc between its retaining plug and the wall of the cylinder in which the pressure relief device is housed. In the case of a bursting disc made of a plastic material, the disc is preferably integrally formed with a retaining plug of the same material having a circumferential shoulder abutting a stepped bore, whereby the plastic bursting disc mimics the closure member. However, the present invention recommends only primary and secondary pressure-relief devices as necessary for normal safety levels. As an alternative to the secondary pressure relief device (blow-ring) already described in detail, either or both of the bursting discs referred to may be employed. For example with regard to a carbon dioxide container fitted with a blow ring or bursting disc, relieving at 120 bar, the container's wall thickness may be reduced considerably so as to lead to a wall burst pressure of 250 bar rather than, typically, 500 bar in previous designs, reducing the weight and cost of the container by nearly half.

Desirably, the longitudinal axes of the various pressure relief devices should all lie substantially parallel to the longitudinal axis of the tubular component, thus assisting the automatic or semi-automatic assembly of the container.

A further feature of the present invention is the provision of a narrow conduit communicating between the container interior and the primary pressure-relief device and in heat-exchange relationship with the tubular component forming the main container wall. By this means, whenever the primary pressure-relief device operates, fluid flowing through the narrow conduit experiences a pressure drop (which advantageously should be at least 5% of the initial internal pressure at the instant of operation of the primary pressure-relief device) which promotes evaporation of any liquid flowing therethrough and causes expansion of an gas phase resulting from such evaporation or flowing from the container interior. Both such evaporation and expansion cause the fluid flowing through the narrow conduit to fall in temperature and, by means of the heat-exchange relationship between the narrow conduit and the tubular component forming the main container wall, the latter is chilled whenever the primary pressure-relief device operates. This chilling effect then causes a slight cooling of the container's contents, lowering the internal pressure slightly and preventing excessive loss of fluid through the primary pressure-relief device. Operation of the primary pressure-relief device results almost invariably from exposure of the fluid container to heat, and so this chilling effect of the narrow conduit is most valuable in minimising the loss of fluid caused by such exposure to heat. The narrow conduit may be provided in several alternate ways: for instance by a long small-diameter tube helically coiled and hel against the inside wall of the tubular component; or a plurality of narrow conduits may be provided by longitudinal grooves formed on the inside of the tubular component during the extrusion of stock metal tube from which the tubular component has been cut (being bounded to form narrow conduits by the tightly-fitting outer surface of the top or end plug(s) pressed into the end(s) of the tubular component); or the top of the end plug(s) may be formed with a narrow helical groove on its (their) outer surface(s) which are bounded by the adjacent tubular component's bore to provide (a) narrow helical conduit(s) communicating as always between the container interior and the orifice of the primary pressure-relief device. Advantageously, but not necessarily, the tubular component should be of metallic material so that the chilling effect may be thermally conducted throughout the tubular component; alternatively, the tubular component may be of plastic material which may advantageously contain, e.g., a metallic or carbon-based filler to improve its thermal conductivity.

Providing the fluid container with multi-purpose capability is achieved by the provision, advantageously integral with the top or end plug (closure member) previously described, of a standardized sealed coupling or shroud to which a variety of adaptors may be quickly and easily attached Preferably, the material comprising the shroud has greater impact strength and elongation before fracture than has the material comprising the top or end plug (closure member). However, the shroud may comprise the same material as the closure member, in which case it may be integrally connected therewith. In either case, the shroud advantageously incorporates a frangible portion (e.g. when th shroud and closure member are of chemically similar materials, a frangible portion may be conveniently effected by partially welding the parts together and/or by providing a locally thin-walled neck), so that undue stress, if applied to the fluid container via the shroud as a result of its attachment to some appliance, will cause the shroud or part of it to break away from the closure member, thus relieving the stress on the container. The shroud may include a male or female threaded section incorporating a seal or a sealing surface; or the threaded section may be replaced instead by a bayonet coupling, or by a toggle-action coupling, or by a snap fitting. However, the present invention discloses that, as part of the disclosed method of construction employing at least a top plug (and sometimes an end plug), at least one plug (closure member) will be formed with an integral or, e.g., welded-on shroud rather than requiring a separate coupling to b attached as in the case of existing known fluid cylinders and which currently require expensive additional neck reduction, machining, welding, brazing or soldering, in consequence.

Desirably, the base portion of the shroud, which extends to cover the outlet orifices of the various pressure relief devices in the closure member, is so shaped that fluid, when escaping from one or more of the devices is guided to atmospheres in a multi-directional fashion. As will be appreciated, such an arrangement minimises the risk of escaping fluid imposing a net reactive "driving force" upon the fluid container, which may cause it to move about in a violent and possibly dangerous manner.

To prevent excessive chilling of the fluid container and its contents during controlled discharge of fluid, and the large fall in internal pressure that would occur in consequence, causing a substantial reduction in the flow rate of discharging fluid, a heat source may be provided to the tubular component by means of a heat storage substance contained within a coaxial cylindrical jacket or outer sleeve. In the present context the expression "heat storage substance" means a substance which undergoes a change in physical, chemical, crystallographic or other state at a temperature above the final operating temperature of the fluid, the change of state resulting in a release of heat.

A number of embodiments according to the present invention will now be more particularly described, by way of example, and with reference to the accompanying drawings.

BRIEF DESCRIPTION OF THE DRAWINGS

FIG. 1 illustrates, in vertical cross-section and approximately two-thirds full size, the fluid cylinder of approximately 375 cc capacity. FIG. 1 is a view in elevation, with the cylinder in its upright position as normally encountered in a water carbonator.

FIG. 2 is also an elevation to the same scale as FIG. 1, partly in vertical cross-section, of a charging head or shroud suitable to be sealingly coupled to the fluid cylinder of FIG. 1 and by means of which the cylinder may be used to dispense either liquid or gaseous carbon dioxide as desired usually into a power appliance using evaporated carbon dioxide as a source of mechanical power.

FIG. 4 illustrates in vertical cross-section a fluid container with an alternative top plug or closure member to that shown in FIG. 1, depicting a secondary pressure-relief device in the form of a bursting disc or cup, together with a coaxial retaining jacket for a heat storage substance and a gas off-take tube which extends to the vicinity of the centre of volume of the container.

DETAILS

Solid $CO_2$ exists only (apart from an extremely rare exception when in high-pressure equilibrium with liquid $CO_2$, which is not encountered in conventional $CO_2$ containers) when:

(a) its pressure is allowed to fall below 5.3 atmospheres (60.4 psig), (b) its temperature is allowed to fall below −56.6° C., and (c) its energy (called "enthalpy") is low.

When conditions (a), (b) and (c) are not allowed to occur in a safety valve of a $CO_2$ container, the presence of solid $CO_2$—and the risk of blockage by it—is obviated. This teaching is not found in any prior art. Accordingly, the present invention provides:

(i) A narrow conduit ("chiller passage") in thermally-conducting relationship with the shell of a container by which any venting $CO_2$ is led to a safety valve. This chiller passage both chills the shell (in order to conserve the $CO_2$ contents of the container) and also warms the flowing $CO_2$ in order to maintain its energy ("enthalpy") and reduce the likelihood of solid $CO_2$ formation due to (b) and (c).

(ii) A safety valve having a special, miniaturised outlet orifice which maintains a pressure within the safety valve's chamber at typically above 45 atmospheres and certainly above a threshold level of 5.3 atmospheres, below which solid $CO_2$ can form according to (a). The combination of (i) and (ii) ensures that $CO_2$ pressure will be considerably above 5.3 atmospheres along the entire gas path from the container interior to the outlet orifice.

Figure 3:
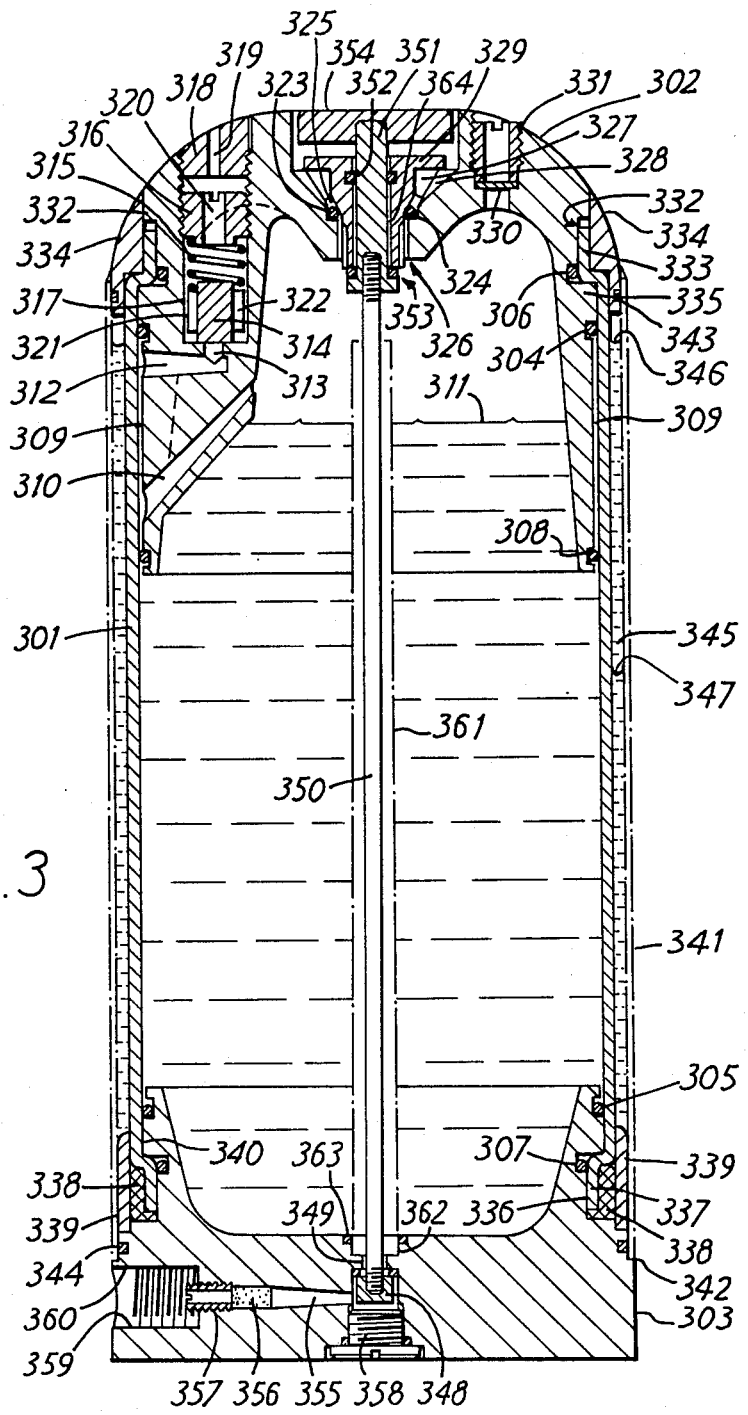
FIG. 3 is an illustration, in vertical cross-section and half full size, of another embodiment of the present invention as viewed in elevation, being a fluid dispensing cylinder of approximately 5.0 liters capacity suitable for carrying pressure-liquefiable gas, such as carbon dioxide, and for use as a domestic source of the gas or of its liquid phase, from which a fluid cylinder as shown in FIG. 1 can be filled and which may also be used to supply gaseous carbon dioxide by means of simple additional components, thereby facilitating its use as, for instance, a fire extinguisher or a gas-supply apparatus for a gas-operated alarm or other device.

The narrow conduit is really a heat exchanger, whereby heat energy is transferred from a cylindrical shell and to venting $CO_2$. It is not simply a helical passageway as referred to by kucmerosky (U.S. Pat. No. 3,247,967); it need not even be a helical passageway (FIG. 3 shows an alternative employment of a number of longitudinal passageways). Novelty lies in employment of a *heat exchanger* (not taught by prior art) which performs a valuable function of increasing enthalpy of venting $CO_2$, thus reducing the likelihood of solid $CO_2$ formation.

In the event that this heat exchanger is embodied as a helical passageway (as in the FIG. 4 embodiment, for example), the developed length of the helical passageway is typically nearly 3.0 meters; such passageway has a cross-sectional area (for the flow of $CO_2$) of approximately 0.35 square millimeters.

Another important function of the narrow conduit (forming the heat exchanger) is that it provides a very large pressure drop, of the order of 20 to 30 atmospheres when passing $CO_2$ at a flow rate of 1 gram/-second.

This pressure drop provides an important effect in controlling the behavior of the venting valve (in assisting it to open and close repeatedly), in combination with the pressure drop provided by the outlet orifice and the pressure drop provided by the scratch grooves, which allow venting $CO_2$ to bypass the piston section of the venting valve member.

The importance of these three critical pressure drops is explained with reference to FIG. 5 and Table 1.

TABLE 1

| | PRACTICAL DIMENSIONS TYPICAL PNEUMATIC RESISTANCE (R) | | | | | | |
|---|---|---|---|---|---|---|---|
| FLUID | $R_1$ CHILLER PASSAGE | | VALVE | $R_2$ SCRATCH GROOVES | VALVE | $R_3$ OUTLET | VENTING $CO_2$ |
| CONTAINER CAPACITY mL | CROSS-SECTION sq. mm | DEVELOPED LENGTH mm | SEAT DIAM. mm | TOTAL CROSS-SECTION sq. mm | CHAMBER DIAM. mm | ORIFICE DIAM. mm | FLOW RATE gm/sec. |
| 100 | 0.08 | 1350 | 2.0 | 0.08 | 7.0 | 0.17 | 0.33 |
| 300 | 0.35 | 2800 | 2.3 | 0.25 | 8.0 | 0.30 | 1.0 |
| 1000 | 1.73 | 6250 | 2.9 | 0.83 | 10.0 | 0.55 | 3.3 |

Figure 5:
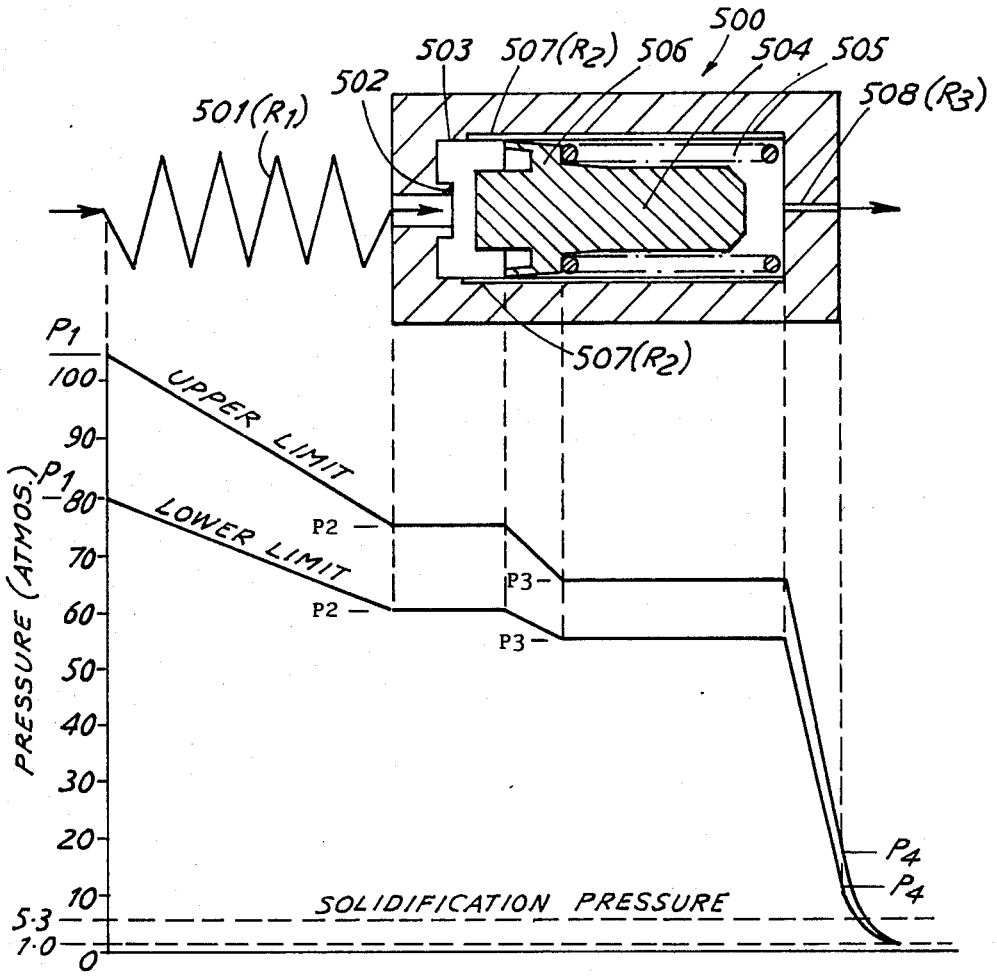
FIG. 5 is a combination of a partially schematic drawing of an embodiment of the invention in combination with a graph of pressures developed in different portions of a pressure-release valve assembly during $CO_2$ venting.

In FIG. 5, the narrow conduit 501 is depicted diagrammatically to represent a pneumatic resistance $R_1$ which is supplied with carbon dioxide from the subject fluid container at a pressure $P_1$ which may lie between a typical UPPER LIMIT of 105 atmospheres absolute and a typical LOWER LIMIT of 80 atmospheres. During venting of the $CO_2$, the pneumatic resistance $R_1$ causes a substantial pressure drop of typically 20 to 30 atmospheres, so that the $CO_2$ fed to the valve seat 502 of the valve assembly 500 is typically at a pressure between UPPER and LOWER LIMITS of 75 and 60 atmospheres, respectively, which is denoted the pressure $P_2$.

The venting $CO_2$ at pressure $P_2$ charges the valve chamber 503 and, as it flows, forces back the valve member 504 against the valve return spring 505, as illustrated in FIG. 5, by acting upon the piston section 506. Scratch grooves 507 allow a limited amount of the venting $CO_2$ to spill past the piston section 506 and provide a second pneumatic resistance $R_2$ which causes a pressure drop of typically between 5 and 10 atmospheres, reducing the venting gas pressure from $P_2$ to an intermediate pressure $P_3$ which may typically be between UPPER and LOWER LIMITS of 65 and 55 atmospheres, respectively.

The only outlet from the valve assembly 500 is via the very small outlet orifice 508, which provides the third and most critical pneumatic resistance $R_3$. While the venting $CO_2$ is flowing, this third pneumatic resistance $R_3$ causes a very, large pressure drop of typically between 45 and 50 atmospheres, reducing the pressure of the venting $CO_2$ to an exit pressure $P_4$ which may fall typically between UPPER and LOWER LIMITS of 15 and 10 atmospheres, respectively. The exhausted $CO_2$ then quickly equilibrates with the local atmospheric pressure.

At the instant that venting starts, the intermediate pressure $P_3$ is of course 1 atmosphere, and therefore a very large pressure difference (of $P_2-1$ atmospheres, which may 66.5 atmospheres) acts upon the piston section 506 and forces the valve member 504 very rapidly to the right (as in FIG. 5), taking it well clear of the valve seat 502 so as to clear away any dirt and to prevent valve chatter. However, as the venting $CO_2$ spills past the piston section via the scratch grooves 507, the intermediate pressure $P_3$ very quickly rises to a level between its UPPER and LOWER LIMITS of 65 and 55 atmospheres, respectively, which acts to return the valve member leftward (as in FIG. 5) to the valve seat 502. This process recurs repeatedly.

Most important of all, the pressure of the venting $CO_2$ within the valve assembly 500 rises very rapidly (typically within 0.02 seconds after the instant that venting is initiated) to the intermediate pressure $P_3$ of between 55 and 65 atmospheres. This is well above the SOLIDIFICATION PRESSURE below which solid $CO_2$ might be formed (see the lower part of the graph in FIG. 5) and ensures that there is no risk of the valve assembly becoming blocked with solid $CO_2$.

To allow the benefits of this invention to be realized in practice, it is important to construct the valve assembly to the correct dimensions and, in particular, to achieve the correct values for the three pneumatic resistances $R_1$, $R_2$ and $R_3$. Therefore, to permit practical realization of the invention, TABLE 1 specifies practical dimensions and values (for the three pneumatic resistances and for the valve seat and valve chamber diameters) for typical fluid containers of capacities 100, 300 and 1000 milliliters and for nominal venting $CO_2$ flow rates of 0.33, 1.0 and 3.3 grams per second.

To allow this invention to be embodied in other capacities of fluid container, values for the three pneumatic resistances and the other parameters of TABLE 1 can be calculated by interpolation or extrapolation (as the case may be) from the values given in TABLE 1.

Details

Figure 1:
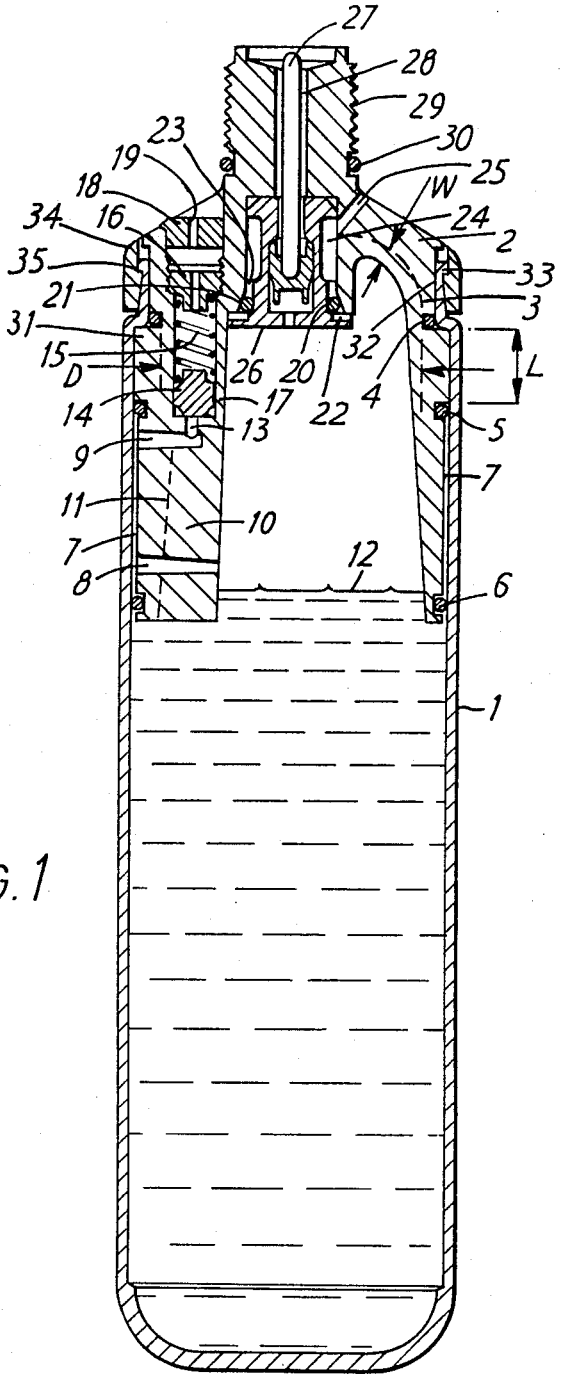
FIG. 1 and FIG. 2 refer to an embodiment of the present invention as applied to a fluid cylinder of approximately 375 cc capacity, designed to hold a pressure-liquefiable gas, such as carbon dioxide, normally at an internal pressure of approximately 55 bar and to supply, for instance, gaseous carbon dioxide to a water carbonator and, for instance, liquid carbon dioxide to a power appliance.

Referring to FIG. 1, the fluid cylinder is largely constituted by a tubular component 1 whose one open end is closed by a top plug 2. The tubular component 1 as shown in FIG. 1 is formed by impact extrusion of an aluminum alloy, such as the high-strength variety designated HE 30 by the British Standards Institution, although other metallic materials, such as aluminum and copper, may be impact-extruded—and stronger materials, such as steel, may be deep-drawn—and employed as the tubular component 1. Suchlike metallic materials are currently to be preferred for the tubular component, but the present invention does not exclude the alternative use of suitably strong and safe plastic materials, such as acetals, polyamides and polyesters, of appropriate wall thickness some 3 to 5 times greater than shown in FIG. 1, depending particularly on the strength and creep resistance of the plastic material. Whatever the material of the tubular component, the present invention requires that it should have an elongation before cracking or fracture of at least 7% and preferably 10% or more. For instance in the case of HE 30 aluminum alloy, an elongation of 12% or more is usually specified, being approximately the "¾ hard" condition and obtained by partly annealing the fully heat-treated (designated HE 30TF) alloy in an oven at a temperature of 250° C. for 30 minutes and by subsequent natural cooling in air at room temperature: this will lead to an ultimate tensile strength of close to 17 tons per square inch and, with a cylindrical wall thickness of 2.7 mm, the tubular component will then exhibit a burst pressure of approximately 250 bar, providing a safety factor of 4.5 in the case of carbon dioxide contained normally at a pressure in the region of 55 bar. The minimum 7% elongation specified permits the subsequent lip-spinning process (described later herein) to be performed satisfactorily and, in addition in the extremely unlikely event of bursting of the tubular component, ensures that it will burst by forming a ductile "buttonhole slit" in its cylindrical section and oriented longitudinally—which is a safe mode of bursting that gives rise to very little risk of flying fragments. The manufacturing processes used to form the tubular component (e.g. impact-extrusion, deep drawing, injection moulding, etc.) all permit the production of large batches (e.g. 1000 to 50,000 at a time) of the tubular component, which may then be, e.g., heat-treated, anodised, plated, washed, etc., in bulk at low cost, obviating the need for and higher cost of undertaking such processes during subsequent cylinder assembly and avoiding all the shortcomings and disadvantages described at the beginning of this specification.

The top plug 2 is advantageously made by injection moulding of a high-strength, low-creep engineering plastic material, such as the polybutylene terephthalate variety of polyester with, e.g., 45% glass reinforcement, such as rynite (Registered Trade Mark) 545, though other plastic, such as acetal, polyacetal, polyamide, other polyesters, either with or without reinforcement, may be used provided that the wall thicknesses and other critical dimensions of stressed material are adequate firstly to lead to a top plug burst pressure considerably higher than that of the tubular component at the highest service temperature envisaged and, secondly, to ensure that the creep strain of the material will not exceed some small figure, such as 1.0%, when the fluid cylinder pressure is held at its highest likely continuous internal pressure, i.e. the highest possible venting pressure of the primary pressure-relief device as described later herein, for example 91 bar in this embodiment, for a very long period, such as 100,000 hours, and at the highest envisaged storage temperatures. For example, the rynite 545 material of the top plug 2 will exhibit a strain of less than 1.0% after 100,000 hours at 60° C. if stressed to a level of 20 $N/cm^2$ so, using the accepted formula for a pressure vessel's hemispherical end, the wall thickness W of the notional "Buried hemisphere" indicated by the dashed line 3 in FIG. 1 should be at least 5.0 mm for a buried hemisphere outside diameter of 49.0 mm in order that an internal pressure of 91 bar will produce a wall stress of no more than 20 N/mm$^2$. As shown in FIG. 1, the actual end wall thickness of the top plug 2 is, to scale, more than 5.0 mm, leading to a stress level much lower than 20 N/mm$^2$ and to a creep strain of much less than 1.0% after 100,000 hours at 60° C. The end wall burst pressure, with an end wall thickness W of 5.0 mm, will be approximately 570 bar at 70° C. for a material having an ultimate tensile strength of 126 N/mm$^2$ at that temperature—such as rynite 545—which is much higher than the approximately 250 bar burst pressure of the tubular component 1 and which provides an ample safety factor of over 10 when employed in a carbon dioxide fluid cylinder at a normal 55 bar internal pressure.

The only other critical dimension of stressed material in the top plug 2 of the FIG. 1 embodiment is the shoulder length L, which must be sufficient to reduce the shear stress in the top plug at diameter D (measured at the root of the groove carrying the lip 'O' ring 4) to a level low enough to ensure that safety criteria similar to those described heretofore for the wall thickness W in respect of burst pressure and long-term creep strain are met. For instance, in the case of using rynite 545 for the top plug 2, the shear stress at diameter D (which is 49.0 mm in the FIG. 1 embodiment) should be no more than 9.0 N/mm$^2$ to ensure that the creep strain of the shoulder 31 in shear will be less than 1.0% after 100,000 hours storage at 60° C. and, assuming a fluid cylinder internal pressure of 91 bar maximum as before, this requires that the shoulder length L should be no less than 12.4 mm, as depicted in the two-thirds-scale drawing of FIG. 1. The internal pressure causing failure of the shoulder 1 in shear at 70° C. (which is chose for this embodiment as the highest *short-term* temperature to which the cylinder may be exposed) will then be approximately 570 bar—for a material, such as rynite 545, having a shear strength of 56 N/mm$^2$ at 70° C. which preserves the same safety factor of over 10 as for the end wall.

Such safety factors are unusually high and suggest that this form of construction, with appropriate end wall thickness W and shoulder length L, will be entirely safe for cylinders containing fluids at pressures considerably higher than the figure of 91 bar employed in the preceding calculations.

The top plug 2 carries an 'O' ring 5 to prevent fluid escape between it and the tubular component 1, so the lip 'O' ring 4 is not essential though recommended in order to reduce the very slow escape of fluid which occurs by permeation through elastomeric materials, such as nitrile elastomer, which may be used for 'O' rings 4, 5 and 6. Upstream 'O' ring 6 is provided to seal the lower extremity (as in FIG. 1) of the top plug so that the narrow conduit 7 (which advantageously is a moulded helical groove similar to a male thread form providing—when bounded by the inner cylindrical surface of the tubular component 1—a helical passageway of approximately 0.3–0.6 square millimeters of cross-sectional area for fluid flow) can be supplied with gas phase from the ullage space above the liquid surface 12, by means of the fluid offtake passage 8 which preferably is a hole moulded in the internal spine 10 which projects inward from the tapering inner surface of the top plug 2 as depicted by dashed line 11. A similar crosshole 9 is provided to lead the fluid leaving the narrow conduit 7 to the orifice 13 of the primary pressure-relief device which comprises a poppet 14, advantageously moulded in a hard grade of an abrasion-resisting elastomeric material, such as polyurethane elastomer, and of substantially cylindrical shape and closely fitting in a cylindrical cavity 17, a compression spring 15 arranged to urge the poppet 14 against the orifice 13, a retaining plug 16 and a venting control plug 18.

The retaining plug 16 is preferably screw-threadedly engaged in the upper (as in FIG. 1) section of the cylindrical cavity 17 so that it may be screwed downwards in order to increase the force applied by the compression spring 15 downwards on the poppet 14—and thence on the orifice 13—until the poppet will seal the orifice at internal fluid pressures up to a certain level called the "primary venting pressure" which, in this embodiment, will be nominally 87 bar so that, when effects, such as temperature expansion of the compression spring, creep and wear, etc., are taken into account, the primary venting pressure will never exceed 91 bar. The venting control plug 18, preferably moulded in the same, e.g., rynite 545 material as the top plug 2 so as to permit welding together of the two, is then advantageously ultrasonically-welded or spin-welded in place to prevent undesired adjustment or the retaining plug 16 and to cause venting fluid to pass through the exit orifice 19 of an outer end of the cylindrical cavity (chamber) 17 to the atmosphere. In operation of the primary pressure-relief device, as soon as the internal pressure reaches the primary venting pressure (this usually being caused by exposure to rising temperature), the poppet 14 is pushed off the orifice 13 and the contained fluid (usually gas phase from the space above the liquid surface 12 but occasionally including liquid phase whenever the gas offtake passage 8 is submerged) flows along the narrow conduit 7, the crosshole 9, through the orifice 13, around the poppet 14 and thence through the central hole seen in the retaining plug 16 in FIG. 1 and finally through the exit orifice 19.

During such operation the fluid passing through the narrow conduit experiences a substantial pressure drop (typically of 5 to 50 bar) which promotes the evaporation of any liquid phase in that fluid and which causes expansion of any resulting or accompanying gas phase. Both of these processes cause a fall in temperature of the fluid flowing through the narrow conduit which is adjacent to the inner wall of the tubular component 1 and therefore in heat-exchange relationship with it. The tubular component is thereby chilled and, especially if made of metallic material, conducts the chilling effect to the contents of the fluid cylinder, bringing about a slight reduction of temperature and hence of the internal pressure. This feature of the present invention thereby tends to annul the effect of high temperature exposure and to conserve the contents of the fluid cylinder. Moreover, any liquid entering the narrow conduit is substantially or completely evaporated, which greatly reduces any risk of damage to or derangement of the primary pressure-relief device by erosion or swelling of the poppet or contraction of the compression spring.

Furthermore, the pressure drop caused by the narrow conduit has another valuable effect in that, within a very few seconds after the primary pressure-relief valve operates, the fluid pressure in the orifice 13 falls and allows the poppet to be returned smartly to seal the orifice, again tending to conserve the contents of the cylinder. This effect is enhanced by the exit orifice 19 which, being of a carefully-controlled size (between, e.g., 0.2 and 0.5 mm diameter) causes the pressure in the cavity 17 downstream of the poppet to rise during venting and to assist the compression spring to return the poppet to seal the orifice, by acting on the downstream face of the poppet in the manner of a piston. Prior to this effect (which may take 2–10 seconds or so to occur, while the flow rate of the venting fluid equilibrates), the poppet 14, being a relatively close fit in the cavity 17 (due to the presence of scratch grooves, not shown, in the wall of the cavity), will have lifted well clear of the orifice 13 owing to the additional lifting force generated by the upstream fluid-pressure acting on the "piston section" of the poppet—which is of a larger cross-sectional area than the orifice 13—so as to allow any, e.g., dirt or grit to be blown clear of the sealing faces of the poppet and orifice, thereby preventing damage to those faces. This additional lifting effect may be controlled not only by the presence of scratch grooves but also by the provision of substantially-longitudinal channels or passages either in the wall of the cavity or in the exterior surface of the poppet (not shown in FIG. 1 but described later herein).

The exit orifice 19 also controls the flow rate of venting fluid to a relatively low level, not only to conserve the cylinder's contents, but also in order to assure relatively quiet and gentle venting, so as not to cause any alarm. Alternatively, an audible warning device (as described later) can be incorporated in the pressure-relief device at this point, if desired. Furthermore, in the case of gases, such as carbon dioxide, whose solid phase cannot exist above a certain threshold pressure (5.3 absolute atmospheres in the case of carbon dioxide), the exit orifice 19 which may also be considered as a pressure reducing or resistor device or as a throttling passageway, is sized so that, during venting, the pressure in the cavity 17 downstream of the poppet 14 will rise quickly to a level above the said threshold level, causing any solid phase therein to change to liquid phase and thereby to be more easily expelled to atmosphere.

By means of the above-described features, the primary pressure-relief device achieves a very high degree of safety and reliability throughout the service life of the fluid cylinder, which may be in the region of from 10 to 20 years.

Nevertheless, to achieve a still higher degree of safety and to cater for rare events, such as blockages or human or accidental interference causing failure or maloperation of the primary pressure-relief device, or accidents, such as dropping of the cylinder into boiling water or exposure to fire which may cause the primary pressure-relief device to become overloaded (i.e. to be unable to vent fluid sufficiently quickly to prevent a continuing rise in internal pressure), a secondary pressure relief device, for example, in the form of "blow ring" 20—suitably comprising a conventional 'O' ring of nitrile elastomer—mounted so as to be squeezed approximately 10–40% and to seal a first recess 21 communicating via a plurality of channels 22 with the cylinder interior against fluid flow therefrom at internal pressures up to a "secondary relief pressure" , is provided. The first recess 21 may advantageously be an annulus which, as shown in FIG. 1, tapers to an annular throat 23 which should have an annular width equal to between 0.20 and 0.50 of the uncompressed thickness of the blow ring 20 (depending upon that thickness, the chosen hardness of the blow ring and the desired secondary relief pressure). The annular throat is of course disposed on that side of the blow ring that is remote from the cylinder interior (i.e. the "downstream" side), and communicates with a second recess 24 having an annular width greater than the uncompressed thickness of the blow ring (so as not to be sealed by the blow ring) and communicating by a plurality of holes 25 with the cylinder exterior. In this embodiment wherein carbon dioxide is the contained fluid, the secondary pressure–relief device is designed to operate at a secondary relief pressure of 108 bar nominally (and never of greater than 124 bar under the effect of manufacturing tolerances and varying hardnesses of the blow ring) and then to vent all of the cylinder's contents in a relatively noisy manner so as to attract attention. Of course the blow ring will not reseal automatically and the cylinder must be returned for examination of the reasons for apparent failure of the primary pressure-relief device and for any rectification thereof, before the cylinder may be refilled and returned to service. Furthermore, being inaccessible, the blow ring is much less prone to interference and thereby provides a dependable back-up to the primary pressure-relief device, ensuring that the internal pressure will never exceed 124 bar in service and thereby maintaining a safety factor of at least 1.6—even in the rare and extreme circumstances described. The features of this type of secondary pressure-relief device may be seen more clearly in the embodiment of FIG. 3, described later herein.

For convenience in this FIG. 1 embodiment, the secondary pressure-relief device is incorporated around the valve assembly 26. However, if preferred the secondary pressure-relief device may be located elsewhere in the top plug or closure member, in which case the longitudinal axis thereof should, advantageously, lie substantially parallel to the longitudinal axis of the container. The valve assembly, being of known type, will not be described in detail herein, apart from disclosing the actuating rod 27 which extends through the outlet passage 28 and which, when pressed downwards (as in FIG. 1), allows fluid to flow from the interior and out through the outlet passage 28. The upper end of the top plug (as in FIG. 1) is formed to incorporate an integral male thread 29 (which distinguishes the present invention from known types of gas cylinder having a separate—usually male-threaded metallic coupling normally welded, brazed or soldered to a metallic cylinder having a neck reduction) which allows the whole cylinder to be screwed into the appliance or other device to be supplied with fluid, normally in such a manner that the actuating rod 27 is depressed so as to allow fluid flow to the appliance or other device. A coupling ')' ring 30, advantageously of nitrile elastomer containing molybdenum disulphide or other lubricant, is provided as shown in order to seal the coupling of the whole cylinder to certain types of appliance or device, such as the charging head shown in FIG. 2, being specifically an 'O' ring in *radial* compression so as to seal *before* the male thread is screwed fully home and the actuating rod is depressed, so as to prevent fluid escape during this coupling process.

The top plug 2 is provided with an integral circumferential shoulder 31 having a diameter advantageously between 0.2% and 1.0% greater than the internal diameter of the tubular component 1, so as to provide an interference fit between the two when the tubular component is assembled axially onto the top plug. A similar or slightly lesser amount of interference is provided over that section of the top plug which comprises the major diameter of the male thread form providing the helical passageway of the narrow conduit 7, so that the said major diameter will be pressed firmly against the bounding inner cylindrical wall surface of the tubular component in order substantially to prevent axial fluid flow therebetween and to constrain the fluid to flow helically along the narrow conduit.

Above (as in FIG. 1) the circumferential shoulder 31 and the lip 'O' ring 4, there is provided a retaining groove 32 having a diameter of approximately 7% less than that of the circumferential shoulder (in the case of using HE 30 aluminum alloy for the tubular component, and generally in the range of from 5 to 10% less in the case of other materials used for the tubular component) and into which the upper extremity (as in FIG. 1) of the tubular component is firmly deformed, advantageously by crimping, by swaging or by rotating the cylinder about its central axis while it is firmly supported in, e.g., a lathe and by applying a "spinning tool" having a rolling head to roll on and press the upper extremity of the tubular component radially inwards, so as to form a cold-spun lip 33 gripping the retaining groove "core" 32.

Although a cold-spun lip as just described may be adequate for fluid cylinders containing fluids at pressure up to, e.g., 50 bar (especially where such cylinders are of a diameter less than, e.g., 30 mm, in which case pressures up to even 200 bar may be safely contained by a cold-spun lip as just described), the embodiment of FIG. 1 achieves a much greater degree of safety by employing a retaining band 34, which may be of one of a variety of materials, including plastic, cast aluminum or zinc alloy or other metallic material, forged or extruded or machined metallic material, etc., (these examples having been stated in broadly rising order of strength and security) and of an inside diameter substantially equal to the outside diameter of the cold-spun lip 33 and advantageously of 0.1% to 0.5% lesser diameter so as to grip the cold-spun lip firmly. The retaining band may be fitted in place by firstly stretching it elastically using, e.g., a tool similar to those of known type which are used to stretch and fit 'O' rings, etc., so that it will slide over the cold-spun lip. Another technique, in the case of a metallic retaining ban especially, is the use of pre-heating to expand the retaining band and then allowing it to be slid into place, whereupon it will cool and contract firmly onto the cold-spun lip. In any case it is advisable that the retaining band should embrace substantially or nearly all of the extent of the cold-spun lip and also should be fitted with its downward edge (as in FIG. 1) closely adjacent to the circumferential shoulder 31 so as to minimise any incipient tendency of the cold-spun lip to be withdrawn downwards (as in FIG. 1) over the circumferential shoulder by the withdrawal force generated on the tubular component 1 by the internal fluid cylinder pressure. A retaining band of the type so far described may have a plain cylindrical inside surface (as illustrated later herein, in the FIG. 3 embodiment) or, advantageously, its inside surface may be roughened or slightly tapered outwards in a downward direction (as in FIG. 1), so as to cause it to grip the cold-spun lip more firmly. Suchlike retaining bands are usually adequate to hold the tubular component firmly in place against internal pressures up to between 200 and 500 bar, depending upon the diameter, material and wall thickness of the tubular component.

However, the FIG. 1 embodiment is intended for extremely high safety, to which end the retaining band 34 incorporates a circumferential ridge 35 on its inside surface and advantageously has a cross-section in the shape of a saw-tooth oriented as shown in FIG. 1 so that the circumferential ridge 35 acts as a barb to prevent any incipient tendency of the cold-spun lip to expand and withdraw over the circumferential shoulder 31, by means of the engagement of the circumferential ridge 35 with a circumferential groove (also having reference numeral 35 in FIG. 1) in the outside surface of the cold-spun lip and has a cross-section substantially matching that of the circumferential ridge 35. Such a circumferential groove may of necessity cause a local thinning of the cold-spun lip, but the cold-spun lip is on that side of the lip 'O' ring 4 that is remote from the cylinder interior so, even if 'O' ring 5 fails to seal, the cold-spun lip does not have to resist any internal fluid pressure in the manner of the remainder of the cylindrical section of the tubular component 1 which has to resist both a longitudinal stress of a level proportional to the internal fluid pressure and a hoop stress equal to twice that level. Therefore all of the strength of the cold-spun lip is available for the function of retaining the tubular component on the top plug 2 and, even if the cold-spun lip is reduced to half its general wall thickness by and in the region of the circumferential groove, it will experience a longitudinal stress no greater than the hoop stress experienced by the main cylindrical wall of the tubular component. In practice the circumferential groove may have a depth equal to, e.g., one third of the cold-spun lip's wall thickness. Fluid cylinders of this type of construction invariably fail at a sufficiently high internal pressure when the hoop stress in the main cylindrical section of the tubular component reach a level high enough to cause bursting in the shape of a safe "buttonhole slit", with little or no accompanying damage to or deformation of the cold-spun lip or of its retaining band.

As an alternative to the retaining band, a tubular component may be employed in which that part which is deformed to provide a lip has a wall which is greater in thickness and thereby stronger than the remaining cylinder wall of the component. Typically the lip portion has a wall thickness up to 80% greater than that of the body portion of the component, which thickness may extend for up to 5 to 10% of the length of the component. Such an embodiment is depicted in FIG. 4 of the accompanying drawings. If necessary, a retaining band is also used with a tubular component having a thickened lip.

It will be seen from the foregoing description and FIG. 1 that all of the fluid cylinder's component parts are assembled co-axially (or parallel with the cylinder axis but offset therefrom in the case of the primary pressure-relief device component parts), which is a deliberate approach to the cylinder design according to the present invention whereby the whole cylinder is optionally assembled automatically, permitting high-volume production at low cost. Indeed, the total direct cost of the fluid cylinder as in FIG. 1 is estimated to be less than 40% of the cost of current fluid cylinders of convention construction.

Figure 2:
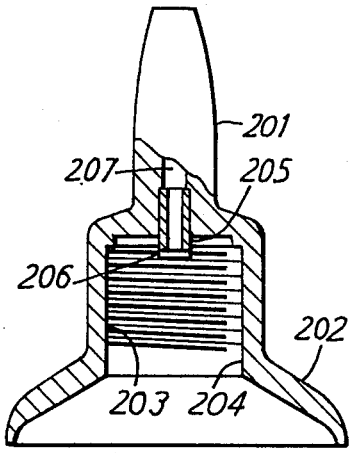

Referring to the charging head shown in FIG. 2, a nozzle member 201 (containing a known type of dispensing valve) advantageously injection-moulded of a high-strength plastic material, such as acetal, polyacetal, polyester or a grade of polyamide known as "Supertough zytel" (Registered Trade Mark) Grade ST 81, with an integrally-moulded tlared portion or shroud 202 which, when the charging head is screw-threadedly engaged by means of its integrally-moulded female thread 203 engaging with the male thread 29 of the top plug 2 of the fluid cylinder shown in FIG. 1., conforms closely to the top side of the top plug (as in FIG. 1) so as to present a neat appearance, and is provided with an integrally-moulded sealing surface 204 to embrace the coupling 'O' ring 30 of FIG. 1 and to compress it radially by approximately 20% so as to seal the charging head to the top plug. This embracing of the coupling 'O' ring 30 by the sealing surface 204 occurs during screw-engagement of the charging head to the top plug approximately 1 to 2 turns before the actuating probe 205 (shown in FIG. 2 comes into contact with the actuating rod shown in FIG. 1, and the final screwing-down (as in FIGS. 1 and 2) of the charging head causes the actuating probe 205 to depress the actuating rod 27 and to admit fluid from the fluid cylinder to the interior of the charging head. The actuating probe 205 is provided with a central hole and a cross-slotted tip 206 as shown in FIG. 2 to permit flow of fluid onwards to the dispensing passage 207. The combined assembly of the charging head of FIG. 2 and the fluid cylinder of FIG. 1 may, when the latter contains a liquefied gas, be inverted so that the charging head may then dispense liquefied gas, instead of dispensing gas phase when in the upright position shown in FIGS. 1 and 2.

The shroud 2 impedes access or tampering with the primary pressure-relief device and the blow-ring, and ensures that fluid venting therefrom is guided to atmosphere by the shroud in a multi-directional fashion, thereby substantially eliminating any jet reaction which might otherwise cause the fluid cylinder to move about in a violent and possibly dangerous manner.

The charging head or shroud of FIG. 2 is only one example of several alternative adaptor assemblies incorporating the features disclosed and which ma be used to couple the fluid cylinder of FIG. 1 to any of a variety of appliances, such as fire extinguishers; medical equipment, such as anaesthetic and oxygen dispensers; appliances operated by compressed or vapourised gases, and various welding and industrial equipment. Thereby a standard cylinder design, such as that illustrated in FIG. 1, may satisfy a large number of uses and the said adaptor assemblies may easily be detached, lightening the cylinder to save transportation costs when it is returned for refilling.

The fluid container illustrated in FIG. 4 is similar to that shown in FIG. 1 and as described above, and identical or substantially identical features are referred to by the same reference numerals. However, as is readily apparent, there are also significant differences between the two containers and these are described below in detail.

A secondary pressure-relief device is present in the container of FIG. 4 in the form of at least one bursting disc shown generally as 401. The actual disc may be metallic or of a plastic material and assemblies incorporating examples of such discs are illustrated respectively in FIGS. 4*a* and 4*b*.

The disc assembly 401 corresponds to the enlarged assembly shown in FIG. 4*a* and takes the form of a part hemispherical thin metal disc 402, usually of copper, nickel or brass, which is shaped over a cylindrical metal or plastic retaining plug 403. The disc is formed with a skirt portion 404 which extends over the substantially cylindrical surface 405 of the remaining plug for a distance portion equal to at least 20% of the diameter of the disc. Such an arrangement provides a more secure fitting for the disc when the assembly as a whole is interference fitted or, advantageously, ultrasonically or spin-welded at 408 into its housing in the top plug or closure member 2. An 'O' ring 406 provides additional circumferential sealing means to ensure that fluid does not escape from the container via the base of the skirt portion. The broken lines 407 show the form of the disc when under excess fluid pressure and immediately prior to bursting.

An alternative bursting disc assembly is shown in FIG. 4*b* in which the thin part-hemispherical disc 410 and its retaining plug 411 are integrally formed (e.g. by precision injection molding) from the same plastic material. Preferably, the plastic material is the same as that comprising the top plug or closure member 2, when the disc assembly may be conveniently ultrasonically-welded to its housing at 408. The broken lines 412 show the form of the disc when under excess fluid pressure and immediately prior to bursting.

The integral retaining plug 411 has a circumferential shoulder 413 which abuts and is thereby retained by the stepped bore 439; this mimics the main circumferential shoulder 440 of the top plug or closure member and the lip portion 426 that retains the top plug or closure member and causes the bursting disc assembly to experience the same stress patterns as in the top plug or closure member, further increasing safety.

Advantageously, and for maximum safety, both types of secondary pressure-relief devices may be present in fluid containers according to the present invention, designed or "set" to burst at different fluid pressures. Thus, for convenience the three pressure-relief devices may be housed symmetrically (at 120° spacing) around the upper end of the interior of the top plug or closure member.

Fluid venting to atmosphere from any of the relief devices contacts the base portion 415 of a shroud indicated generally as 416 which has the effect of spreading the fluid around the top of the top plug, within the gap between the plug and the shroud, thus equalizing the pressure of the fluid so that, on escaping from the shroud via a series of holes 417 symmetrically arranged around the circumference of the shroud, the risk of fluid having a net jet reaction effect upon the container (causing it to move about in a possibly dangerous fashion) is reduced to a minimum.

Desirably, the shroud 416 and the top plug or closure member comprise similar materials (e.g., polyesters) of relatively high tensile strength but low elongation and impact strength for the top plug or closure member, and of relatively low tensile strength but high elongation and impact strength for the shroud, in order that the shroud may protect the top plug or closure member against shocks and impacts, so that the two parts may be welded together (by known ultrasonic or spin-welding methods) either at a series of points 418 or to form a continuous annulus to provide a frangible connection. Such a safety measure allows the shroud 416 to break away from the top plug if subjected to undue stress arising, for example, from the presence of an attached appliance, thus minimizing the risk of the stress being transmitted to and damaging the upper extremity of the top plug and so maintaining the pressure integrity of the container. Parts 419 on the shroud represent means for attaching suitable appliances and may conveniently take the form of a threaded section or threaded sleeve.

Advantageously, a hollow annulus 441 extends within the upper portion of the shroud 416, so as to provide a frangible neck 442 of a relatively thin wall and of low strength so that part 443 may break away safely in the event of excessive loading applied to the fluid container when installed in an appliance.

To provide a warning when fluid escapes from the primary pressure-relief device indicated generally at 420, an audible alarm device comprising a flexible sound emitting diaphragm 421, mounted between the cup 422 and plug 423, may be conveniently incorporated downstream of the bleed poppet cylinder 424.

As described above, the tubular component 1 has a lip portion 426 with a greater wall thickness than that of the remainder of the component. Lip portions extending up to 10% of the length of the tubular component and up to 150% greater in thickness than the body portion of the component have been exploited.

A coaxial cylindrical jacket or sleeve 430 comprising, for example, an impact extruded aluminum alloy provides a container for a heat storage substance 431 in contact with the wall of the tubular component 1. The high thermal conductivity of the alloy also permits an easy inflow of heat to the heat storage substance. The base 432 of the jacket is flat to allow for freestanding, which shape is also easier to impact extrude than a concave end or convex hemispherical end. A centralising ring 433 of a suitable plastic material, having slots 434 to allow for movement of the heat storage substance, is also provided.

A gas off-take tube 435, extending to the vicinity of the centre of volume of the container ensures gas only off-take when the container is up to half full of liquid. This arrangement permits the operation of the container when in any attitude.

The purpose and function of the heat storage substance is described below in detail in relation to the container shown in FIG. 3.

As will be appreciated, the use of a heat storage substance enables the fluid container of the present invention to be exploited as a "power capsule". An alternative form of such a capsule, designed to maximise the benefit of the heat storage substance, provides a gas off-take tube from the orifice 436 with a channel connecting the opening 437 to an extended valve plug 438. The cavity created by this extension of the valve plug may be filled with a metal foam, mesh or sintered or porous metal to minimise the collection and retention in the cavity of liquified gas. In addition, one of the two secondary pressure-relief devices may be replaced by a non-return filling valve of known design (e.g. a steel ball in a tapered tube) to allow for rapid direct filling of the fluid container.

Referring to the larger fluid cylinder illustrated at half full size (and of approximately 5.0 liters water capacity) as in FIG. 3, a tubular component 301 is provided which, in this embodiment, is a length of thin-walled pipe (which may be a metal, metallic alloy or which may comprise metallic strip wound and embedded in a plastic material, such as epoxy resin or other thermosetting or thermoplastic material, as in the known dunlopipe (Registered Trade Mark) so as to be corrosion-resistant resistant, having two open ends which are closed by a top plug 302 and an end plug 303 which (in this embodiment) comprise aluminum diecastings and which are tightly-fitting in the tubular component 301 and sealed thereto firstly by the plug 'O' rings 304 and 305 and, secondly, for additional leak-tightness, by the lip 'O' rings 306 and 307. The tubular component in this embodiment (which is intended for containing liquefied carbon dioxide or the like in terms of pressure) has a burst strength of approximately 300 bar, and the top and end plugs have a burst strength of from 600 to 700 bar.

The top plug 302 is provided with an upstream 'O' ring 308 to bound a plurality of narrow conduits 309 formed in the outer cylindrical surface of the top plug in the form of several substantially-longitudinal channels bounded by the inner cylindrical surface of the tubular component 301 and having a total cross-sectional area for fluid flow of between approximately 2 and 5 square millimeters communicating between a fluid offtake passage 310 [which is angled as shown to communicate with the ullage space above the liquid surface 311 (as in FIG. 3)]and a crosshold 312 so as to cause a pressure drop in the range of from 5 to 50 bar when the primary pressure-relief device operates. The primary pressure-relief device comprises an orifice 313 which communicates with the crosshole 312 and which is normally sealed by a poppet 314 pressed downwards (as in FIG. 3) by a compression spring 315 which is enclosed and guided slidably (as also is the poppet 314) by the substantially-cylindrical cavity 317. A retaining plug 316 having a hole 320 for fluid escape is advantageously screw-threadedly engaged in the upper (as in FIG. 3) extension of the cylindrical cavity 317 for adjustment of the compression spring force bearing down on the poppet so that the poppet will seal the orifice against internal fluid pressures up to approximately 100 bar, above which "primary venting pressure" the poppet will lift off the orifice and allow fluid to vent from the interior.

The poppet 314 [which in this embodiment may advantageously be injection-moulded in "Supertough" zytel (Registered Trade Mark) Grade ST 801 or in HYTREL (Registered Trade Mark) semielastomer]is formed with a piston section 321 which is closely-fitting in the cylindrical cavity 317 (subject to the presence of one or more scratch grooves in the wall of the cavity) and which is of approximately three times the diameter of the bottom (as in FIG. 3) face of the poppet where it seals the orifice 313. By this means, as soon as the poppet is lifted off the orifice by internal fluid pressure, that fluid pressure acts on the greater diameter and cross-sectional area of the piston section 321 of the poppet so as to lift it well clear of the orifice and to allow any dirt, grit or other harmful solid particles to be blown clear of the sealing surfaces of the poppet and orifice, thereby minimising any damage to them. Passages 322 for fluid flow may advantageously be moulded in the outer cylindrical surface of the piston section 321 of the poppet (or in the adjacent cylindrical wall) to provide escape channels substantially parallel with the central axis of the poppet for the escape of such solid particles and also to reduce and thereby regulate the extent of the additional poppet lift afforded by the piston section.

A venting control plug 318 is securely fixed (to prevent tampering with or accidental adjustment of the retaining plug 316) in the upper (as in FIG. 3) extremity of the cylindrical cavity 317 and provided with one or more exit orifices 319 of a total cross-sectional area sufficient to control fluid flow so that, when the poppet is lifted off of the orifice 313 by internal cylinder pressure, the fluid pressure in the cylindrical cavity 317 immediately above it (as in FIG. 3) quickly rises to exceed a threshold pressure above which no solid phase (deriving from the fluid) can exist (i.e. 5.3 absolute atmospheres in the case of carbon dioxide), because (above that pressure) any such solid phase immediately changes to liquid or gas phase and is thereby expelled from the cylindrical cavity and out through the exit orifice(s) 319 without risk of blocking or jamming, etc., of the primary pressure-relief device. Furthermore, the narrow conduit(s) 309 cause, via their stated pressure drop effect on the venting fluid, substantially all of any liquid phase flowing through them to be evaporated so that little if any liquid phase will enter the primary pressure-relief device and either change (transiently) to solid phase or otherwise harm the operation of the primary pressure-relief device by causing, e.g., swelling of the poppet or temperature effects on the spring rate of the compression spring. Also, according to the invention, any such evaporation of any liquid phase (and the expansion of any subsequent vapour and of the accompanying gas phase from the ullage space above the liquid surface 311 promoted by the stated pressure drop along the narrow conduits 309 will cause the fluid flowing therein to fall in temperature and, by virtue of the heat-exchange relationship between the narrow conduit(s) and the tubular component 301, to chill the tubular component 301. This chilling effect is conducted to the contents of the cylinder, lowering their temperature and pressure slightly (or tending to prevent any rise in those values) and so tending to conserve the contents of the cylinder.

The exit orifice 319 also controls the flow rate of venting fluid to a relatively low level in order to conserve fluid during the short period during which the fluid pressure in the cylindrical cavity 317 builds up and causes the poppet to return smartly to seal the orifice 313 [this smart return action being further enhanced by the fall in pressure at the orifice in consequence of the pressure drop along the narrow conduit(s)], and also in order that such venting will be gentle and quiet.

To cater for more extreme situations, such as fire, the present invention provides a secondary pressure-relief device comprising a blow ring 323, advantageously being a conventional 'O' ring moulded in nitrile elastomer with a small addition of molybdenum disulphide or other lubricant so as to ensure its consistent operation as a pressure-relief device, a first recess 324 of generally annular form with an annular width approximately equal to 80% of the thickness of the uncompressed blow ring 323 and tapering down to a throat 325 of annular form (in this embodiment) and width equal to approximately 30 to 40% of the thickness of the uncompressed blow ring and against which the blow ring may be urged by fluid pressure from the cylinder interior communicating with the first recess 324 through a plurality of channels 326, and a second recess 327 of generally annular form (in this embodiment) with an annular width greater than the thickness of the uncompressed blow ring so as not to be sealed by the blow ring (and this is accomplished in the FIG. 3 embodiment by forming the second recess 327 with a diverging annulus away from the throat 325 as shown in FIG. 3 and provided with a plurality of venting channels 328 communicating with the cylinder exterior. These features of the secondary pressure-relief device incorporated in a threaded member 329 and in the adjoining surfaces of the top plug 302 are shown in FIG. 3 and are designed in this embodiment so that the blow ring will pass through the throat 325 into the second recess 327 and thereby allow all of the contents of the fluid cylinder to be vented to atmosphere in a relatively sudden, rapid and noisy manner in the event that the internal pressure reaches a nominal level of 125 bar (and in no circumstances greater than 140 bar) so that a safety factor of at lest 2.1 for the 300 bar pressure tubular component is maintained at all times.

A third safety device in the form of a conventional bursting disc 330, advantageously made of aluminum or copper or one of their alloys, such as brass, and secured in a gas-tight manner in the top plug by a hollow plug 331 screw-threadedly engaged with a female thread in the top plug, is provided so as to burst if the internal pressure rises to approximately 175 bar and in order then to vent all the cylinder's contents to atmosphere.

In order to secure the tubular component to the top plug according to the present invention, a top retaining groove 332 is provided with a diameter approximately 5% less than the inside diameter of the tubular component and into which the upper (as in FIG. 3) extremity of the tubular component is spun or otherwise deformed so as to form a cold-spun lip 333, which is then rippingly retained by a top retaining band 334 [formed as shown in FIG. 3 from, advantageously, diecast aluminum or injection-moulded high-strength plastic material, such as e.g. rynite 545 (Registered Trade Mark), and assembled by prior elastic stretching or prior heat-expansion followed by relaxation or cooling so as to grip the cold-spun lip over its whole length and, in particular, at that part of the cold-spun lip closely adjacent to the circumferential shoulder 335 provided on the top plug 302].

The lower (as in FIG. 3) extremity of the tubular component 301 is similarly spun or otherwise deformed firmly into a retaining groove 336 in the end plug 303 so as to form a lower cold-spun lip 337 which, according to another preferred method of the present invention, is held firmly in place by a gap-filling adhesive, such as plastic padding (Registered Trade Mark) or devon (Registered Trade Mark) or similar hard-setting adhesives based on epoxy or polyester or polyurethane or suchlike compounds, which is applied on the outer circumference of the cold-spun lip 337 so as substantially to fill the cavity 338 between the cold-spun lip 337 and the inner cylindrical surface of a lower retaining band 339 which has a diameter significantly larger than that of the cold-spun lip's 337's exterior surface and, in this embodiment, substantially equal to the outer diameter of the tubular component 301 so as to grip it in the region of the lower circumferential shoulder 340. This method of retaining the cold-spun lip 337 avoids the need to stretch or heat-expand the lower retaining band 339 prior to fitting or to provide the engaging circumferential ridge and groove of the embodiment shown in FIG. 1, and naturally causes the outer surface of the lower retaining band 339 to be proud of the outer surface of the tubular component, enabling it to support another feature of the present invention described as follows.

An outer sleeve 341 of thin seamed metal sheet or plastic material or the like may, in many applications of the present invention wherein it is desired to withdraw fluid from the cylinder at a high rate or for a protracted period as for instance in the case of its use as a fire extinguisher, be fitted substantially co-axially with the tubular component and supported by the outer surfaces of the lower retaining band 339 and the top retaining band 334, being prevented from downward (as in FIG. 3) movement relative to the end plug by a ledge 342 thereon and being sealed against leakage by an upper seal 343 and a lower seal 344, and the annular space between the tubular component and the outer sleeve partly or substantially filled with a heat storage substance 345. The action of the heat storage substance 345 is to prevent excessive chilling of the cylinder and its contents—and the excessive fall in internal pressure that would occur in consequence and cause an excessive reduction in the flow rate of withdrawn fluid—by releasing heat to the tubular component. The heat released may be the sensible heat of the heat storage substance 345 which in that case should advantageously be a liquid or solid substance of high specific heat, such as water or paraffin oil or paraffin wax or lithium metal; or the heat released may be the latent heat of fusion as a liquid changes (i.e. freezes) to its solid state in which case the heat storage substance should advantageously be a liquid having a freezing point between the ambient temperature in which the fluid cylinder is normally stored or used and the lowest admissible temperature to which the tubular component may fall before the internal pressure becomes inadequate, in order that such latent heat will be released in time to arrest an admissible fall of internal pressure and, furthermore, so that the heat storage substance may re-melt naturally by heat flow from the ambient surroundings following use of the cylinder to supply fluid at a high rate or for a protracted period. Liquids suitable for such release of latent heat include, in the case of a fluid cylinder supplying carbon dioxide gas for fire-extinguishing purposes, those having a freezing point between approximately −20° C. (at which temperature the vapour pressure of carbon dioxide is 19.7 bar) and approximately +20° C. (above which temperature the heat storage substance may not be remelted by heat from the ambient surroundings); those generally preferred include such substances as water (freezing point 0° C.), polyethylene glycols having various freezing points between −20° and 20° C. depending upon their mean molecular weight and, in particular, recently-developed heat storage substances, such as clathrates and salt-hydrate solutions in water, of which a preferred example is the one identified as calor 12 (Registered Trade Mark) by the company Calor Group Limited and having a freezing point of approximately +12° C. Alternatively, the heat storage substance 345 may be such as to release latent heat of hydration or solution or crystallisation at a certain falling temperature between +20° C. and −20° C. (for example), such as paraxylene which forms large nodular crystals and releases both latent heat and heat of crysallisation at falling temperatures in the band of +10° C. to +8° C., approximately.

Such heat storage substances may be filled into the annular space between the tubular component and the outer sleeve 341 to a high level 346 leaving a little free ullage space above it as shown in FIG. 3 to allow for expansion effects, or to a lower level 347 below the upstream 'O' ring 308 so that the chilling effect caused by the narrow conduit(s) 309 may still be conducted by the tubular component 301 to the liquid contents (when their surface level is above the lower level 347; if the liquid surface 311 falls below the level of the upstream 'O' ring 308 approximately—and certainly if it falls below the lower level 347—the chilling effect as aforesaid is no longer needed because the ullage space above the liquid surface is sufficient to prevent any substantial rise in internal pressure and, therefore, to prevent venting of the contents through the primary pressure-relief device) without any impediment by the heat storage substance which would otherwise tend to annul the chilling effect.

A fluid cylinder containing approximately 3 kilogrammes of largely-liquid carbon dioxide (as in the FIG. 3 embodiment) and used as a fire extinguisher (when it is required to produce gaseous carbon dioxide for a protracted period and at a relatively high flow rate, without a substantial fall in internal pressure) may by virtue of the heat storage substance 345 and relating features of the present invention, be used to fight a fire continuously and for a protracted period until the contents are substantially exhausted, providing approximately 2000 liters of carbon dioxide gas—sufficient to exclude air from the volume of a small kitchen or garage to an extent sufficient to extinguish, e.g., a large cooking-fat fire or a blazing car engine compartment. By contrast, without the heat storage substance and relating features, only some 500 to 1000 liters of gaseous carbon dioxide may be supplied before the internal cylinder pressure falls to a level insufficient to propel an adequate gas stream at a fire.

Either liquid or gaseous carbon dioxide may be dispensed (or other like gases and liquids) by means of further features now described. A lower valve 348 of known type normally closes a drain orifice 349 in a gas-tight manner, being normally urged upwards (as in FIG. 3) by means of the push-rod 350 connecting it to a plunger 351 guided sealingly through a co-axial bore 364 in the threaded member 329 provided with a rod seal 352 of known type. The lower (as in FIG. 3) end of the plunger 351 incorporates an upper valve 353 of known type so as to provide a second gas-tight seal (the first being the rod seal 352) against fluid escape during the majority of service when the fluid cylinder is not being used to dispense its contents. The sealing diameter of the upper valve 353 is larger than that of the lower valve 348 in order for the internal fluid pressure to cause a net upward force on the lower valve so as to keep it and the upper valve normally closed as shown in FIG. 3. However, the plunger 351 is secured to a button 354 which, when depressed by hand or other means, opens the lower valve 348 and thus the drain orifice 349 while also opening the upper valve 353 so as to annul the upward (as in FIG. 3) force exerted on it by the internal fluid pressure and thereby diminish the necessary force to keep the button 354 depressed during dispensing—which might otherwise become excessive and tiring. A small and tolerable upward return force is provided by the internal fluid force acting on the plunger at the sealing diameter of the rod seal 352, this diameter being approximately 3 to 4.5 mm (i.e. rather less than depicted in FIG. 3 which shows the rod seal 352 and plunger 351 to approximately full-size diameter for the sake of clarity) in the case of carbon dioxide which, having a pressure of some 30 to 50 bar during normal dispensing, will then exert an upward return force on the plunger of between 2 and 8 kilogrammes approximately.

The drain orifice 349 communicates with a discharge passage 355 which may conveniently lead dispensed fluid through a filter 346 held in place by a screw-threaded nipple 357 engaging a female thread provided in the end plug 303. A gas-tight sealed access plug 358 is preferably fitted by screw-threaded engagement co-axially with the end plug and under (as in FIG. 3) the lower valve, and a female-threaded socket 359 having a thread size and form matching that of the male thread 29 in the top plug 2 of the fluid cylinder illustrated in the FIG. 1 embodiment and having a sealing surface 360, such as the sealing surface 204 of the charging head illustrated in FIG. 2, is provided in the end plug co-axially with the nipple 357. By these means a fluid cylinder, such as that depicted in the FIG. 1 embodiment, may be screwed and sealed into the socket 359 (so that the nipple 357, which is hollow and has a cross-slotted tip for fluid flow, depresses the actuating rod 27 and opens the valve assembly 26 of the FIG. 1 fluid cylinder) and, when the button 354 is depressed, liquid carbon dioxide (for example) may flow into the FIG. 1 fluid cylinder so as to refill it for further use.

Alternatively, gaseous carbon dioxide may be dispensed into, e.g., a FIG. 1 fluid cylinder or into the atmosphere by inverting the FIG. 3 fluid cylinder and pressing the button 354.

In the case of fluid cylinders according to the FIG. 3 embodiment which are intended to hold largely-liquified gas but normally to dispense gas while the said fluid cylinder is upright as in FIG. 3 (for example fire extinguishers or nitrous oxide anaesthetic gas dispensers), a tubular stand-pipe 361 may be fitted tightly in the well 362 wherein it is sealed by the wellseal 363 and whereby it is supported substantially co-axially with the push-rod 350, the upper (as in FIG. 3) extremity of the stand-pipe 361 opening into the ullage space above the liquid surface 311, from whence gas rather than liquid may be dispensed downwards through the stand-pipe 361 and the drain orifice 349.

It is to be understood that various alternative features discussed above in relation to FIGS. 1 or 4 are to be considered as equally applicable to the embodiment shown in FIG. 3.

What is claimed is:

1. A pressure-relief valve assembly for operating under conditions at which gaseous carbon dioxide might otherwise change to solid phase and designed to ensure that any phase change is to liquid rather than to solid phase, the valve assembly comprising a chamber with two ends, having at one end a fixed valve seat and a valve orifice which communicates with a source of carbon dioxide under a container pressure and having at the other end an outlet restrictor orifice, a valve member movable within the chamber and biased against the container pressure toward a closed position against the valve seat, at which the valve orifice is closed off and means to control pressure in said chamber, the means being responsive, upon displacement of the valve member to an open position away from the said valve seat, to the carbon dioxide when the container pressure exceeds a predetermined limit, in order to return said valve member to the closed position, thus causing the valve member to move between the open and closed positions until said container pressure falls below the predetermined limit at which said means to control pressure maintains the pressure of said carbon dioxide between the valve member and the outlet restrictor orifice above 5.3 absolute atmospheres to prevent solidification of the carbon dioxide within the assembly.

2. An assembly according to claim 1 in which the means to control the chamber pressure in the valve assembly is located upstream of said assembly.

3. An assembly according to claim 1 in which the means to control the chamber pressure in the valve assembly is located downstream of the assembly.

4. An assembly according to claim 3 wherein the means comprises the outlet restrictor orifice downstream of the said valve member arranged to produce a back pressure on the valve member on each occasion that fluid is released through the valve orifice.

5. An assembly according to claim 1 wherein the valve member is guidingly supported in said chamber.

6. An assembly according to claim 3 wherein said valve member provides a snug fit in said chamber and wherein grooves or channels in the walls of said chamber or valve member permit passage of carbon dioxide between the chamber walls and said member.

7. An assembly according to claim 1 wherein the valve member is biased against the valve seat by a spring.

8. An assembly according to claim 1 wherein the cross-sectional area of the valve member is substantially greater than the cross-sectional area of that part of said valve member which acts to seal the valve orifice.

9. An assembly according to claim 1 in combination with an audible alarm arranged to be actuated by carbon dioxide released from the said valve orifice.

10. An assembly according to claim 4 wherein the outlet orifice has a diameter of from 0.2 mm to 0.5 mm.

11. An assembly according to claim 4 wherein said means includes a plug upstream of the said outlet orifice, the position of the said plug being adjustable with respect to said outlet orifice to control the amount of the bias of said valve member.

12. An assembly according to claim 7 wherein said spring is retained by a plug upstream of said outlet orifice, the position of the plug being adjustable with respect to said outlet orifice.

13. An assembly according to claim 1 including an upstream helical passageway by which carbon dioxide reaches the assembly.

14. A pressure relief device for operating under conditions at which gaseous carbon dioxide might otherwise change to solid phase and designed to ensure that any phase change will be to liquid rather than solid phase, the device comprising a chamber incorporating at one end a fixed valve seat and a valve orifice which communicates with a source of carbon dioxide under a container pressure, a valve member movable within the said chamber and biased against the container pressure towards a position against said valve seat to close off said valve orifice, and an outlet restrictor orifice means communicating with said valve member, said valve orifice and said outlet restrictor orifice being proportioned so that the pressure of carbon dioxide between the said valve member and said outlet restrictor orifice is maintained above 5.3 absolute atmospheres to prevent solidification of the said carbon dioxide within the device.

15. A pressure-relief valve assembly for transmitting a fluid flow containing liquid carbon dioxide comprising a chamber incorporating at one end a fixed valve seat defining an inlet valve orifice, a valve member movable within the chamber and biased against the pressure of said carbon dioxide towards a position against said valve seat to close said inlet valve orifice and means comprising an outlet restrictor orifice being responsive, upon displacement of the valve member to an open position away from the said valve seat by the carbon dioxide when the pressure of said carbon dioxide exceeds a predetermined limit, to maintain the pressure of the carbon dioxide between the said valve member and said outlet restrictor orifice above 5.3 absolute atmospheres to prevent solidification of the carbon dioxide within the assembly.

16. A container having a pressure-relief valve assembly and wherein the container is a container for storing carbon dioxide under pressure and the valve assembly is a pressure-relief valve assembly according to claim 15.

17. A pressure-relief valve assembly for a liquid-carbon-dioxide-storage container, the valve assembly comprising:

a chamber having an inlet end and an outlet end, the inlet end comprising an inlet valve orifice and a fixed valve seat, a valve member movable within the chamber, means to bias the valve member against pressure of carbon dioxide in the container and toward the valve seat to close off the inlet valve orifice, and means at the outlet end to establish and to maintain a pressure within the chamber above 5.3 absolute atmospheres when pressure of carbon dioxide in the container moves the valve member away from the valve seat and thus permits carbon dioxide to enter said chamber.

18. A pressure-relief valve assembly according to claim 17 wherein the means at the outlet end is an outlet resistor orifice.

19. A container for storing carbon dioxide under pressure and having a pressure-relief valve assembly, the valve assembly being a valve assembly according to claim 17, whereby solidification of carbon dioxide within the assembly is prevented.

20. A pressure-relief valve for a container in which carbon dioxide is maintained under a pressure in excess of 80 atmospheres absolute, said valve comprising a chamber provided with a valve seat at an entry end and an exit orifice at an outlet end, a valve member within said chamber and having a seat engaging portion and a piston portion of cross-sectional area greater than said seat-engaging portion, a biasing means to urge said seat-engaging portion onto said valve seat, wherein the exit orifice is of a size sufficient to constitute means, when in operation, to maintain a pressure of carbon dioxide in the chamber in excess of 5.3 atmospheres absolute, a pressure which precludes solidification of carbon dioxide and resulting blockage of the exit orifice and which is able to exert a back pressure on the piston portion to assist returning the seat-engaging portion into sealing engagement with the valve seat and one or more passages which bypass the piston portion to permit a controlled escape of the carbon dioxide past the piston portion so that the valve member is urged to close said entry to the chamber.

21. A valve according to claim 20 in which the valve member is biased to move within the chamber by a spring.

22. A valve according to claim 20 in which the passages which bypass the piston portion comprise grooves or channels in the chamber wall or piston wall.

23. A valve according to claim 22 in which the extent of the grooves or channels in the chamber wall is such that the piston portion may be unseated from the valve seat by a short distance before carbon dioxide can escape via said grooves or channels.

24. A valve according to claim 22 in which the passages have a cross-sectional area in the range of from 0.08 sq.mm to 0.83 sq.mm.

25. A valve according to claim 20 in which the entry valve seat has a diameter in the range of from 2 mm to 2.9 mm.

26. A valve according to claim 20 in which the chamber is cylindrical with a diameter in the range of from 7.0 mm to 10.0 mm.

27. A valve according to claim 20 in which the exit orifice has a diameter in the range of from 0.17 mm to 0.55 mm.

28. A valve according to claim 20 which includes a plug upstream of the exit orifice, the position of the plug being adjustable with respect to the exit orifice to control the amount of the biasing means of the valve member.

29. A valve according to claim 20 including a heat exchanging device operably connected thereto at the entry end of the chamber.

30. A container for storing carbon dioxide under a pressure in excess of 80 atmospheres absolute consisting of a tubular component in which at least one open end thereof is closed by a closure member, the closure member having located therein a pressure-relief valve according to claim 20.

31. A container according to claim 30 in which the outside diameter of the closure member is from 0.2% to 1.0% greater than the internal diameter of the tubular component so as to provide an interference fit between the closure member and the tubular component.

32. A container according to claim 30 in which the tubular component comprises a deformable material capable of at least 7% elongation before fracture.

33. A container according to claim 32 in which the tubular component comprises a metal or plastic material.

34. A container according to claim 33 in which the tubular component comprises an aluminum alloy.

35. A container according to claim 30 in which the closure member comprises a metallic or plastic material.

36. A container according to claim 35 in which the closure member comprises a polyamide material.

37. A container according to claim 30 in which the closure member has a circumferential shoulder over which an open end of the tubular component is deformed to provide a lip of reduced diameter which engages with the shoulder.

38. A container according to claim 37 in which the part of the tubular component which is deformed to provide a lip has a wall thickness which is greater than that of the cylinder wall of th tubular component.

39. A container according to claim 37 in which the closure member is held in position by an annular band having an internal diameter substantially equal to the outside diameter of the lip, which band surrounds and grips the lip at a point adjacent to the circumferential shoulder.

40. A container according to claim 39 in which any gap between the inner surface of the band and the outer surface of the lip is filled with an adhesive.

41. A container according to claim 39 in which the inside surface of the band is formed with a circumferential ridge which engages with a circumferential groove in the outer surface of the lip.

42. A container according to claim 41 in which the ridge and groove have a saw-tooth profile and are so oriented that the ridge acts as a barb to prevent any incipient movement of the lip towards the shoulder.

43. A container according to claim 30 in which the longitudinal axis of a carbon dioxide filling/emptying device lies on or substantially parallel to the longitudinal axis of the tubular component.

44. A container according to claim 30 in which more than one pressure-relief device is located in the closure member.

45. A container according to claim 44 in which the longitudinal axis of the pressure-relief devices lies substantially parallel to the longitudinal axis of the tubular component.

46. A container according to claim 44 in which at least one of the pressure-relief devices comprises a metallic bursting disc or cup.

47. A container according to claim 46 in which the disc or cup has a skirt of a length which is at least 20% of the diameter of the bursting disc or cup.

48. A container according to claim 44 in which at least one of the pressure-relief devices comprises a plastic bursting disc or cup.

49. A container according to claim 48 in which the disc or cup is integral with a retaining plug.

50. A container according to claim 49 in which the plug has a circumferential shoulder abutting a stepped bore whereby the shape of the combined disc and plug mimics that of the closure member.

51. A container according to claim 30 in which a narrow conduit connects the interior of the container with the pressure-relief valve and extends in heat-exchange relationship with the tubular component in order to utilize a fall in temperature or evaporative cooling of carbon dioxide passing through the conduit to cool the contents of the container following operation of the valve.

52. A container according to claim 51 in which the conduit comprises a helical groove on the outside surface of the closure member that is adjacent to the inside surface of the tubular component.

53. A container according to claim 51 in which the conduit has a cross-sectional area in the range of from 0.08 sq.mm to 1.73 sq.mm and the conduit has a length between 1350 mm and 6250 mm.

54. A container according to claim 30 in which a frangible shroud for guiding escaping carbon dioxide in a multi-directional fashion and with means for attaching a variety of adaptor assemblies is connected to the closure member.

55. A container according to claim 54 in which the material comprising the shroud has greater impact strength and elongation before fracture than has the material comprising the closure member.

56. A container according to claim 54 in which the shroud comprises material which is compatible with that of the closure member and is integrally connected therewith.

57. A container according to claim 30 in which at least part of the length of the tubular component is in contact with a heat storage substance.

58. A fluid-dispensing container of substantially cylindrical shape for storing carbon dioxide under a pressure in excess of 80 atmospheres absolute consisting of a tubular component made of a deformable material capable of at least 7% elongation before fracture in which at least one open end thereof is closed by engagement with a substantially cylindrical closure member which is inserted into the open end, the closure member having located therein a filling/emptying device and one or more pressure-relief valves for the container and an outside diameter which is substantially equal to the internal diameter of the tubular component, and wherein a narrow conduit connects the interior of the container with one of the pressure-relief valves and extends in heat-exchange relationship with the tubular component in order to utilize a fall in temperature with the evaporative cooling of carbon dioxide passing through the conduit to cool the contents of the container and also to put thermal energy into the carbon dioxide following operation of the valve and at least part of the length of the tubular component is in contact with a heat storage substance; wherein one pressure-relief valve has a pressure-relief valve assemble according to claim 1.

* * * * *